US009482973B2

(12) United States Patent
Inoue et al.

(10) Patent No.: US 9,482,973 B2
(45) Date of Patent: Nov. 1, 2016

(54) TONER, METHOD OF MANUFACTURING THE TONER, DEVELOPER, AND PROCESS CARTRIDGE

(71) Applicants: Ryota Inoue, Shizuoka (JP); Yoshihiro Moriya, Shizuoka (JP); Masahiko Ishikawa, Shizuoka (JP); Satoshi Takahashi, Kanagawa (JP); Tatsuki Yamaguchi, Shizuoka (JP)

(72) Inventors: Ryota Inoue, Shizuoka (JP); Yoshihiro Moriya, Shizuoka (JP); Masahiko Ishikawa, Shizuoka (JP); Satoshi Takahashi, Kanagawa (JP); Tatsuki Yamaguchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/631,308

(22) Filed: Feb. 25, 2015

(65) Prior Publication Data

US 2015/0261111 A1 Sep. 17, 2015

(30) Foreign Application Priority Data

Mar. 17, 2014 (JP) ..... 2014-053395
Dec. 24, 2014 (JP) ..... 2014-259968

(51) Int. Cl.
*G03G 9/08* (2006.01)
*G03G 9/087* (2006.01)
*G03G 9/09* (2006.01)

(52) U.S. Cl.
CPC ..... *G03G 9/08733* (2013.01); *G03G 9/08* (2013.01); *G03G 9/0804* (2013.01); *G03G 9/0819* (2013.01); *G03G 9/0825* (2013.01); *G03G 9/08755* (2013.01); *G03G 9/08782* (2013.01); *G03G 9/08797* (2013.01); *G03G 9/0904* (2013.01)

(58) Field of Classification Search
CPC ..... G03G 9/08782; G03G 9/08797
USPC ..... 430/108.8
See application file for complete search history.

(56) References Cited

U.S. PATENT DOCUMENTS

| | | | |
|---|---|---|---|
| 2005/0026066 | A1 | 2/2005 | Tanaka et al. |
| 2005/0031980 | A1 | 2/2005 | Inoue et al. |
| 2005/0164112 | A1 | 7/2005 | Ohki et al. |
| 2006/0046174 | A1 | 3/2006 | Ohki et al. |
| 2006/0057488 | A1 | 3/2006 | Inoue et al. |
| 2006/0063089 | A1 | 3/2006 | Tanaka et al. |
| 2006/0068312 | A1 | 3/2006 | Yamashita et al. |
| 2006/0099529 | A1 | 5/2006 | Tanaka et al. |

(Continued)

FOREIGN PATENT DOCUMENTS

| | | |
|---|---|---|
| JP | 5-341577 | 12/1993 |
| JP | 7-084401 | 3/1995 |

(Continued)

OTHER PUBLICATIONS

U.S. Appl. No. 14/626,113, filed Feb. 19, 2015, Takahashi, et al.

(Continued)

*Primary Examiner* — Mark A Chapman
(74) *Attorney, Agent, or Firm* — Oblon, McClelland, Maier & Neustadt, L.L.P.

(57) ABSTRACT

A toner is provided. The toner includes a binder resin and a release agent. The toner satisfies the following inequation:

$$0.45 \leq (S1/S2) \leq 1.00$$

wherein S1 and S2 represent areas of quadrangles circumscribing the release agent and the toner, respectively, in a cross-sectional image of the toner obtained by a transmission electron microscope (TEM).

14 Claims, 9 Drawing Sheets

(56) References Cited

U.S. PATENT DOCUMENTS

| | | | |
|---|---|---|---|
| 2006/0160011 | A1 | 7/2006 | Inoue et al. |
| 2006/0210903 | A1 | 9/2006 | Ohki et al. |
| 2006/0251979 | A1 | 11/2006 | Watanabe et al. |
| 2007/0059626 | A1 | 3/2007 | Inoue et al. |
| 2007/0141506 | A1 | 6/2007 | Inoue et al. |
| 2008/0090165 | A1 | 4/2008 | Yamada et al. |
| 2008/0226998 | A1 | 9/2008 | Ishii et al. |
| 2008/0227002 | A1 | 9/2008 | Moriya et al. |
| 2009/0003885 | A1 | 1/2009 | Sabu et al. |
| 2009/0117480 | A1 | 5/2009 | Yamada et al. |
| 2009/0162770 | A1 | 6/2009 | Sako et al. |
| 2010/0104965 | A1 | 4/2010 | Inoue et al. |
| 2010/0104970 | A1 | 4/2010 | Norikane et al. |
| 2010/0129748 | A1 | 5/2010 | Inoue et al. |
| 2010/0183967 | A1 | 7/2010 | Sabu et al. |
| 2010/0216068 | A1 | 8/2010 | Kotsugai et al. |
| 2010/0330489 | A1 | 12/2010 | Inoue et al. |
| 2011/0065036 | A1 | 3/2011 | Inoue et al. |
| 2011/0104608 | A1 | 5/2011 | Nakajima et al. |
| 2011/0124838 | A1 | 5/2011 | Kotsugai et al. |
| 2011/0223530 | A1 | 9/2011 | Inoue et al. |
| 2011/0281213 | A1 | 11/2011 | Sakashita et al. |
| 2012/0264049 | A1 | 10/2012 | Masuda et al. |
| 2012/0270147 | A1 | 10/2012 | Katoh et al. |
| 2012/0295188 | A1 | 11/2012 | Nakajima et al. |
| 2012/0322005 | A1 | 12/2012 | Tanaka et al. |
| 2013/0045442 | A1 | 2/2013 | Moriya et al. |
| 2013/0065172 | A1 | 3/2013 | Moriya et al. |
| 2013/0095422 | A1 | 4/2013 | Yamamoto et al. |
| 2013/0149642 | A1 | 6/2013 | Sabu et al. |
| 2013/0171550 | A1 | 7/2013 | Amemori et al. |
| 2013/0244167 | A1 | 9/2013 | Yamashita et al. |
| 2013/0244168 | A1 | 9/2013 | Yamashita et al. |

FOREIGN PATENT DOCUMENTS

| | | |
|---|---|---|
| JP | 2007-199463 | 8/2007 |
| JP | 2008-292976 | 12/2008 |
| JP | 2009-134061 | 6/2009 |
| JP | 2009-294492 | 12/2009 |
| JP | 2010-102195 | 5/2010 |

OTHER PUBLICATIONS

U.S. Appl. No. 14/615,911, filed Feb. 6, 2015, Moriya, et al.

U.S. Appl. No. 14/626,113, filed Feb. 19, 2015 Inventor: Takahashi, et al.

U.S. Appl. No. 14/615,911, filed Feb. 6, 2015 Inventor: Moriya, et al.

TONER, METHOD OF MANUFACTURING THE TONER, DEVELOPER, AND PROCESS CARTRIDGE

CROSS-REFERENCE TO RELATED APPLICATIONS

This patent application is based on and claims priority pursuant to 35 U.S.C. §119(a) to Japanese Patent Application Nos. 2014-053395 and 2014-259968, filed on Mar. 17, 2014 and Dec. 24, 2014, respectively, in the Japan Patent Office, the entire disclosure of each of which is hereby incorporated by reference herein.

BACKGROUND

1. Technical Field

The present disclosure relates to a toner for developing electrostatic latent image in the fields of electrophotography, electrostatic recording, electrostatic printing, etc. The present disclosure further relates to a method of manufacturing the toner, a developer using the toner, and a process cartridge using the toner.

2. Description of the Related Art

In electrophotography, electrostatic recording, electrostatic printing, etc., a toner is once adhered to a latent image bearer, such as an electrostatic latent image bearer, on which an electrostatic latent image has been formed in a process called developing process. The toner is then transferred from the electrostatic latent image bearer onto a transfer medium such as paper in a process called transfer process. The toner is then fixed on the transfer medium in a process called fixing process. In the fixing process, the toner is generally melted by contact with a heated roller or belt, which is an advantageous method in terms of thermal efficiency. (This method is hereinafter referred to as contact heating fixing method.) However, the contact heating fixing method is likely to cause an offset phenomenon in which toner is disadvantageously adhered to the heated roller or belt.

In attempting to prevent the occurrence of the offset phenomenon, toners containing a release agent, such as a wax, have been proposed. For example, a toner containing a wax having a predetermined endothermic peak observable by differential scanning calorimetry has been proposed. As another example, a toner containing a candelilla wax, a higher fatty acid wax, a higher alcohol wax, a plant natural wax (e.g., carnauba wax, rice wax), or a montan wax has been proposed.

In the contact heating fixing method, the release agent is melted in a rapid manner when the toner passes through the heated roller or belt. The release agent is thereby exposed at the surface of the toner. The exposed release agent prevents the toner from adhering to the fixing member (i.e., the roller or belt). The release agent exerts influence on the occurrence of both a cold offset phenomenon, which is occurred at low temperatures, and a hot offset phenomenon, which is occurred at high temperatures.

In a case in which the release agent is positioned near the surface of the toner for the purpose of accelerating exposure of the release agent, the occurrence of the offset phenomenon can be prevented, but the release agent will have come to adhere to other members while the toner is being stirred in a developing device. The toner will be pressed against carrier particles or photoconductors and firmly adhere thereto, causing decrease in charge quantity.

The release agent should be protected inside the toner when the toner is being stirred or stored. On the other hand, the release agent should be efficiently exposed at the surface of the toner in such a short time during which the toner passes through the fixing member.

Many attempts have been made to determine a proper dispersion particle diameter for the release agent dispersed in the toner for preventing the occurrence of the offset problem while maintaining toner productivity. It is generally very difficult to contain the wax in the form of fine particles inside the toner without exposing them at the surface of the toner because the wax particles are inevitably finer than the toner particles.

From the standpoint of giving resistance to the offset phenomenon (hereinafter "hot offset resistance") to the toner, it is more effective that the release agent exists in the form of a relatively large block rather than in the form of fine particles locally distributed over the toner. If the large block of the release agent is achieved by excessively increasing the content of the release agent, the toner will deteriorate in strength and become easy to get crushed, causing charge quantity deterioration and background fouling.

A toner containing a release agent having predetermined aspect ratio and size has been proposed. The toner is reported to have improved low-temperature fixability, back fouling resistance, and chargeability. However, this toner is considered to be still insufficient in terms of durability or strength while maintaining offset resistance and toner chargeability. In particular, when the toner is used for a non-magnetic one-component developing process, the toner will be excessively loaded with a toner layer regulating blade and firmly fixed thereto, causing deterioration in image quality. Therefore, the toner is required to have durability higher than that of two-component developers.

Accordingly, there has been a demand for a toner which achieves a good combination of offset resistance and durability with a small amount of release agent.

SUMMARY

In accordance with some embodiments of the present invention, a toner is provided. The toner includes a binder resin and a release agent. The toner satisfies the following inequation:

$$0.45 \leq (S1/S2) \leq 1.00$$

wherein S1 and S2 represent areas of quadrangles circumscribing the release agent and the toner, respectively, in a cross-sectional image of the toner obtained by a transmission electron microscope (TEM).

In accordance with some embodiments of the present invention, a method of manufacturing the above toner is provided. The method includes forming liquid droplets by discharging a toner composition liquid in which the binder resin and the release agent are dissolved or dispersed in a solvent; and solidifying the liquid droplets into fine particles.

In accordance with some embodiments of the present invention, a developer is provided. The developer includes the above toner and a carrier.

In accordance with some embodiments of the present invention, a process cartridge is provided. The process cartridge includes a latent image bearer and a developing device to develop a latent image on the latent image bearer with the above toner.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1A:
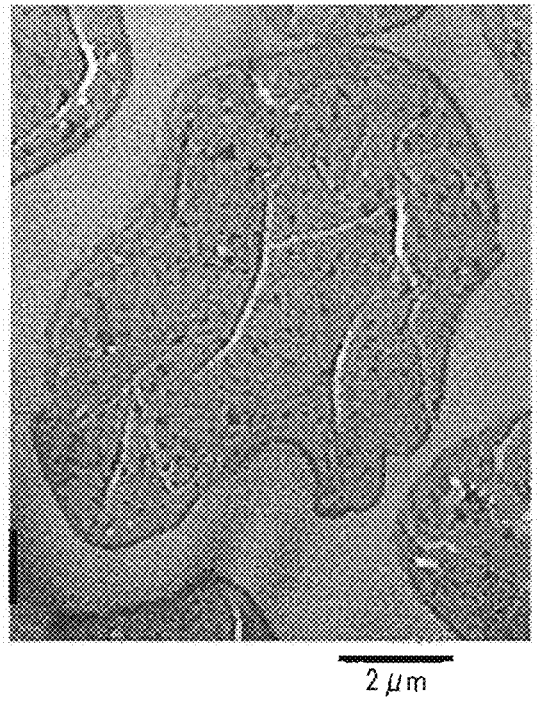
FIGS. 1A and 1B are photographs of the toner obtained by a transmission electron microscope (TEM) in accordance with some embodiments of the present invention.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

One object of the present invention is to provide a toner which has a good combination of offset resistance, charge stability, and background fouling resistance, and is capable of providing high-definition high-quality image for an extended period of time, by positioning a release agent in the toner in such a way that the toner strength will not be damaged and the release agent will efficiently exude from the toner.

In accordance with some embodiments of the present invention, a toner is provided which has a good combination of offset resistance, charge stability, and background fouling resistance, and is capable of providing high-definition high-quality image for an extended period of time.

In accordance with some embodiments of the present invention, a toner including a binder resin and a release agent is provided. In a cross-sectional image of the toner obtained by a transmission electron microscope (TEM), an area S1 of a quadrangle circumscribing the release agent and an area S2 of a quadrangle circumscribing the toner satisfy the following inequation:

$$0.45 \leq (S1/S2) \leq 1.00$$

The area S1 of a quadrangle circumscribing the release agent and the area S2 of a quadrangle circumscribing the toner are determined from a cross-sectional image of the toner obtained by a transmission electron microscope (TEM).

In the TEM observation, first, the toner is embedded in an epoxy resin and cut into ultrathin sections with an ultramicrotome (ultrasonic). The ultrathin sections are observed by a transmission electron microscope at a magnification that the areas S1 and S2 of quadrangles circumscribing the release agent and the toner, respectively, are measurable. Fifty randomly-selected cross-sectional surfaces of the toner are sampled. The images of the sampled cross-sectional surfaces are analyzed by a software program ImageJ and subjected to a measurement of s1 and s2.

The area s1 represents the area of the largest quadrangle circumscribing a release agent domain included in a cross-sectional surface of one sampled toner particle.

The area s2 represents an area of the sampled toner particle.

The value s1/s2 is determined with respect to each of the fifty cross-sectional surfaces. The value S1/S2 is determined by averaging the s1/s2 values determined with respect to the fifty cross-sectional surfaces, and the following inequation is satisfied: $0.45 \leq (S1/S2) \leq 1.00$.

FIG. 1A is a photograph of the toner obtained by a transmission electron microscope (TEM) in accordance with some embodiments of the present invention. Prior to the TEM observation, the ultrathin sections are dyed with ruthenium and/or osmium so as to enhance contrast of the release agent domains in the toner and determine s1 and s2.

Figure 1B:
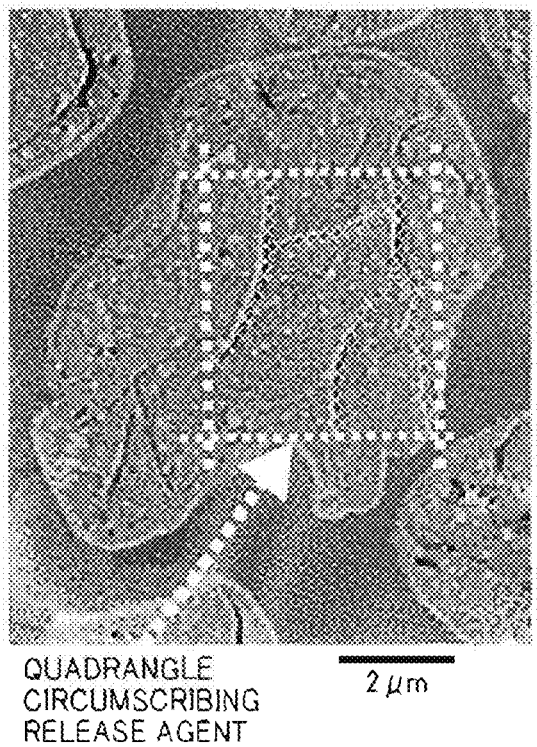

FIG. 1B is a contrast inversion image of the photograph shown in FIG. 1A. The contrast of release agent domains is more enhanced and plots are made along the center of the release agent domain. This image can be further binarized, if necessary. Any imaging process can be employed for the purpose of clarifying the state of the release agent.

As described above, the area S1 of a quadrangle circumscribing the release agent and the area S2 of a quadrangle circumscribing the toner satisfy the following inequation: $0.45 \leq (S1/S2) \leq 1.00$. When S1/S2 is less than 0.45, it is likely that both ends of the release agent domain are not positioned at the surface of the toner particle. Thus, the release agent cannot smoothly exude from the toner particle and the offset phenomenon may be caused in the fixing process. When S1/S2 exceeds 1.00, it is likely that the release agent is exposed at the surface of the toner particle, and toner charge deterioration and background fouling may occur upon bleeding of the release agent. More preferably, the following inequation is satisfied:

$$0.70 \leq (S1/S2) \leq 1.00.$$

How to measure the area S1 of a quadrangle circumscribing the release agent and the area S2 of a quadrangle circumscribing the toner is explained with reference to FIG. 2.

Figure 2:
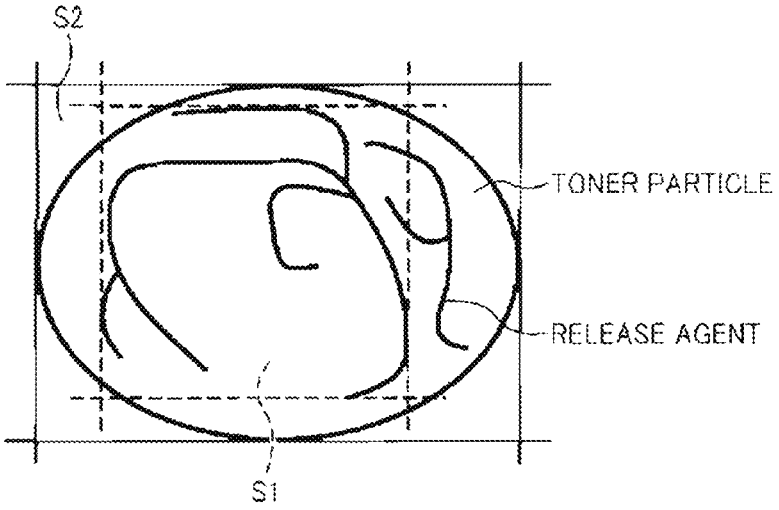
FIG. 2 is an explanatory chart illustrating a measurement method of an area S1 of a quadrangle circumscribing a release agent and an area S2 of a quadrangle circumscribing a toner particle.

Referring to FIG. 2, the area S1 is defined as the area of a quadrangle enclosed by: A) two parallel lines each passing through an end of a release agent domain which provide the largest distance therebetween; and B) other two parallel lines perpendicular to the two parallel lines of A) and tangent to the release agent domain.

The area S2 is defined as the area of quadrangle enclosed by: C) two parallel lines tangent to the outer periphery of a toner particle which provide the largest distance therebetween; and D) other two parallel lines perpendicular to the two parallel lines of C) and tangent to the outer periphery of the toner particle.

In accordance with some embodiments of the present invention, the release agent is a wax, and the content of the wax in the toner is from 1% to 20% by weight, when the content is determined by converting an endothermic quantity of the wax determined by a differential scanning calorimetry (DSC) into weight. In addition, the amount of the wax existing in a region ranging from the surface to 0.3 μm in depth of the toner is not less than 0.1% by weight and less than 4% by weight, when the amount is determined by an attenuated total reflection infrared spectroscopy (FTIR-ATR).

How to measure the amount of the wax is described in detail below.

The total amount of the wax in the toner is measured by a differential scanning calorimetry (DSC). The toner and wax alone are each subjected to a measurement of endothermic quantity under the following conditions.

Measuring device: Differential scanning calorimeter (DSC60 from Shimadzu Corporation)

Amount of sample: About 5 mg

Heating rate: 10° C./min

Measuring range: From room temperature to 150° C.

Measuring environment: In nitrogen gas atmosphere

The total amount of the wax is calculated from the following formula (A).

$$\text{Total Amount of Wax(\% by weight)} = (\text{Endothermic Quantity of Wax in Toner}(J/g) \times 100)/(\text{Endothermic Quantity of Wax Alone}(J/g)) \quad (A)$$

Even if the outflow of the wax has occurred in the toner production process and not all the raw-material wax is incorporated in the resulting toner, the total amount of the wax contained in the resulting toner can be effectively determined by the above procedure.

The amount of the wax existing at the surface of the toner is measured by an attenuated total reflection Fourier transform infrared spectroscopy (FTIR-ATR). According to the measurement principle of FTIR-ATR, the measuring depth is about 0.3 μm. Thus, the amount of the wax existing in a region ranging from the surface to 0.3 μm in depth of the toner can be measured. The measuring procedure is as follows.

First, 3 g of the toner is pelletized for 1 minute at a load of 6 t using an automatic pelletizer (Type M No. 50 BRP-E from Maekawa Testing Machine Mfg. Co., LTD.) and formed into a pellet having a diameter of 40 mm and a thickness of about 2 mm.

The surface of the pellet is subject to a measurement with FTIR-ATR.

As the measuring device, a microscopic FTIR device SPECTRUM ONE (from PerkinElmer Inc.) equipped with an ATR unit is used. The measurement is performed in micro ATR mode using a germanium (Ge) crystal having a diameter of 100 μm.

The incidence angle of infrared ray is set to 41.5°, the resolution is set to 4 $cm^{-1}$, and the cumulated number is set to 20.

The intensity ratio of the peak arising from the wax to that arising from the binder resin is defined as the relative amount of the wax existing at the surface of the toner. The measurement is repeated four times changing the measuring position. The measured values are averaged.

The absolute amount of the wax existing at the surface of the toner is determined from the relative amount thereof with reference to a calibration curve compiled from several samples in which a known amount of the wax is uniformly dispersed in the binder resin.

The wax existing in the region ranging from the surface to 0.3 μm in depth of the toner can smoothly exude from the toner and effectively exert toner releasability.

Preferably, the amount of the wax existing at the surface of the toner measured by the FTIR-ATR is not less than 0.1% by weight and less than 4% by weight. When the amount of the wax existing at the surface of the toner is not less than 0.1% by weight, it means that the wax existing near the surface of the toner is not insufficient. Thus, the toner can exert sufficient releasability when being fixed. When the amount of the wax existing at the surface of the toner is less than 4% by weight, it means that the wax existing near the surface of the toner is not excessive. Thus, the wax is not exposed at the outermost surface of the toner. The wax will not accelerate adhesion of the toner to carrier particles and will not deteriorate filming resistance of the developer.

To achieve a good combination of offset resistance, chargeability, developability, and filming resistance, the amount of the wax existing at the surface of the toner is preferably from 0.1 to 3% by weight.

Preferably, the total amount of the wax measured by the DSC is from 1% to 20% by weight. When the total amount of the wax in the toner is 1% by weight or more, it means that the wax contained in the toner is not insufficient. Thus, the toner can exert sufficient releasability when being fixed without degrading offset resistance. When the total amount of the wax in the toner is 20% by weight or less, filming resistance and color image gloss will not deteriorate, which is preferable.

Toner Compositions

The toner according to an embodiment of the present invention includes at least a binder resin and a release agent, and optionally other components such as a colorant, a colorant dispersant, and a charge controlling agent. The toner may further include a flowability improver and/or a cleanability improver on its surface, if needed.

Binder Resin

The binder resin is not limited to any particular resin so long it is soluble in an organic solvent. Specific examples of the binder resin include, but are not limited to, a vinyl polymer or copolymer obtainable from a styrene monomer, an acrylic monomer, and/or a methacrylic monomer, a polyester polymer, polyol resin, phenol resin, silicone resin, polyurethane resin, polyamide resin, furan resin, epoxy resin, xylene resin, terpene resin, coumarone indene resin, polycarbonate resin, and petroleum resin.

Specific examples of the styrene monomer include, but are not limited to, styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, p-nitrostyrene, and derivatives thereof.

Specific examples of the acrylic monomer include, but are not limited to, acrylic acid and an ester thereof. Specific examples of the ester of acrylic acid include, but are not limited to, methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate, and phenyl acrylate.

Specific examples of the methacrylic monomer include, but are not limited to, methacrylic acid and an ester thereof. Specific examples of the ester of methacrylic acid include, but are not limited to, methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethyl aminoethyl methacrylate, and diethyl aminoethyl methacrylate.

The following monomers can also be used for preparing the vinyl polymer or copolymer.

(1) Monoolefins such as ethylene, propylene, butylene, and isobutylene.
(2) Polyenes such as butadiene and isoprene.
(3) Vinyl halides such as vinyl chloride, vinylidene chloride, vinyl bromide, and vinyl fluoride.
(4) Vinyl esters such as vinyl acetate, vinyl propionate, and vinyl benzoate.
(5) Vinyl ethers such as vinyl methyl ether, vinyl ethyl ether, and vinyl isobutyl ether.
(6) Vinyl ketones such as vinyl methyl vinyl ketone, vinyl hexyl ketone, and methyl isopropenyl ketone.
(7) N-Vinyl compounds such as N-vinyl pyrrole, N-vinyl carbazole, N-vinyl indole, and N-vinyl pyrrolidone.
(8) Vinyl naphthalenes.
(9) Acrylic or methacrylic acid derivatives such as acrylonitrile, methacrylonitrile, and acrylamide.
(10) Unsaturated dibasic acids such as maleic acid, citraconic acid, itaconic acid, an alkenyl succinic acid, fumaric acid, and mesaconic acid.
(11) Unsaturated dibasic anhydrides such as maleic anhydride, citraconic anhydride, itaconic anhydride, an alkenyl succinic anhydride.
(12) Unsaturated dibasic acid monoesters such as maleic acid monomethyl ester, maleic acid monoethyl ester, maleic acid monobutyl ester, citraconic acid monomethyl ester, citraconic acid monoethyl ester, citraconic acid monobutyl ester, itaconic acid monomethyl ester, alkenyl succinic acid monomethyl ester, fumaric acid monomethyl ester, and mesaconic acid monomethyl ester.
(13) Unsaturated dibasic acid esters such as dimethyl maleate and dimethyl fumarate.
(14) α,β-Unsaturated acids such as crotonic acid and cinnamic acid.
(15) α,β-Unsaturated anhydrides such as crotonic anhydride and cinnamic anhydride.
(16) Monomers having carboxyl group such as anhydrides of α,β-unsaturated acids with lower fatty acids, anhydrides and monoesters of alkenyl malonic acid, alkenyl glutaric acid, and alkenyl adipic acid.
(17) Hydroxyalkyl esters of acrylic or methacrylic acids such as 2-hydroxyethyl acrylate, 2-hydroxyethyl methacrylate, and 2-hydroxypropyl methacrylate.
(18) Monomers having hydroxyl group such as 4-(1-hydroxy-1-methylbutyl)styrene, 4-(1-hydroxy-1-methylhexyl)styrene.

The vinyl polymer or copolymer may have a cross-linked structure formed by a cross-linker having two or more vinyl groups.

Specific examples of the cross-linker include, but are not limited to: aromatic divinyl compounds such as divinylbenzene and divinylnaphthalene; diacrylate and dimethacrylate compounds bonded with an alkyl chain, such as ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, ethylene glycol dimethacrylate, 1,3-butylene glycol dimethacrylate, 1,4-butanediol dimethacrylate, 1,5-pentanediol dimethacrylate, 1,6-hexanediol dimethacrylate, and neopentyl glycol dimethacrylate; and diacrylate and dimethacrylate compounds bonded with an alkyl chain having ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate, diethylene glycol dimethacrylate, triethylene glycol dimethacrylate, tetraethylene glycol dimethacrylate, polyethylene glycol #400 dimethacrylate, polyethylene glycol #600 dimethacrylate, and dipropylene glycol dimethacrylate.

Specific examples of the cross-linker further include diacrylate and dimethacrylate compounds bonded with a chain having an aromatic group and ether bond.

Specific examples of the cross-linker further include polyester-type diacrylate compounds such as MANDA (available from Nippon Kayaku Co., Ltd.).

Specific examples of the cross-linker further include polyfunctional cross-linkers such as pentaerythritol triacrylate, trimethylolethane triacrylate, trimethylolpropane triacrylate, tetramethylolmethane tetraacrylate, oligoester acrylate, pentaerythritol trimethacrylate, trimethylolethane trimethacrylate, trimethylolpropane trimethacrylate, tetramethylolmethane tetramethacrylate, oligoester methacrylate, triallyl cyanurate, and triallyl trimellitate.

Among these cross-linkers, aromatic divinyl compounds (especially divinylbenzene) and diacrylate compounds bonded with a chain having an aromatic group are preferable from the viewpoint of fixability and offset resistance of the binder resin. In particular, combinations of monomers which produce a styrene copolymer or styrene-acrylic copolymer are preferable.

Specific examples of a polymerization initiator for use in preparation of the vinyl polymer or copolymer include, but are not limited to, 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2',4'-dimethyl-4'-methoxyvaleronitrile, 2,2'-azobis(2-methylpropane), methyl ethyl ketone peroxide, acetylacetone peroxide, cyclohexanone peroxide, 2,2-bis(tert-butylperoxy)butane, tert-butyl hydroperoxide, cumene hydroperoxide, 1,1,3,3-tetramethylbutyl hydroperoxide, di-tert-butyl peroxide, tert-butylcumyl peroxide, dicumyl peroxide, α-(tert-butylperoxy)isopropyl benzene, isobutyl peroxide, octanoyl peroxide, decanoyl peroxide, lauroyl peroxide, 3,5,5-trimethylhexanoyl peroxide, benzoyl peroxide, m-tolyl peroxide, di-isopropyl peroxydicarbonate, di-2-ethylhexyl peroxydicarbonate, di-n-propyl peroxydicarbonate, di-2-ethoxyethyl peroxycarbonate, di-ethoxyi sopropyl peroxydicarbonate, di(3-methyl-3-methoxubutyl) peroxycarbonate, acetylcyclohexylsulfonyl peroxide, tert-butyl peroxyacetate, tert-butyl peroxyisobutyrate, tert-butyl peroxy-2-ethyl hexanoate, tert-butyl peroxylaurate, tert-butyl oxybenzoate, tert-butyl peroxyisopropyl carbonate, di-tert-butyl peroxyisophthalate, tert-butyl peroxyallyl carbonate, isoamyl peroxy-2-ethyl hexanoate, di-tert-butyl peroxyhexahydroterephthalate, and tert-butyl peroxyazelate.

When the binder resin is a styrene-acrylic resin, a molecular weight distribution of tetrahydrofuran (THF) solubles in the resin which is measured by gel permeation chromatography (GPC) has at least one peak at a number average molecular weight of from 3,000 to 50,000.

Specific examples of the polyester polymer include, but are not limited to, a divalent alcohol such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and a diol obtained from a polymerization between bisphenol A and a cyclic ether (e.g., ethylene oxide, propylene oxide).

By using a polyol having 3 or more valences or an acid having 3 or more valences in combination, the resulting polyester resin can have a cross-linked structure. The used amount of such a polyol or an acid should be controlled such that the resulting resin is not prevented from being dissolved in an organic solvent.

Specific examples of the polyol having 3 or more valences include, but are not limited to, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

Specific examples of acid for producing the polyester polymer include, but are not limited to, a benzene dicarboxylic acid (e.g., phthalic acid, isophthalic acid, terephthalic acid) and an anhydride thereof, an alkyl dicarboxylic acid (e.g., succinic acid, adipic acid, sebacic acid, azelaic acid) and an anhydride thereof, an unsaturated dibasic acid (e.g., maleic acid, citraconic acid, itaconic acid, alkenyl succinic acid, fumaric acid, mesaconic acid), and an unsaturated dibasic acid anhydride (e.g., maleic acid anhydride, citraconic acid anhydride, itaconic acid anhydride, alkenyl succinic acid anhydride).

Specific examples of the polycarboxylic acid having 3 or more valences include, but are not limited to, trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxy)methane, 1,2,7,8-octanetetracarboxylic acid, enpol trimmer acid, and anhydrides and partial lower alkyl esters of these compounds.

When the binder resin is a polyester resin, a molecular weight distribution of THF solubles in the resin which is measured by gel permeation chromatography (GPC) has at least one peak at a number average molecular weight of from 3,000 to 50,000 from the viewpoint of fixability and offset resistance of the toner. Preferably, the content ratio of THF solubles having a molecular weight of 100,000 or less in the binder resin is from 70% to 100% from the viewpoint of discharge performance. More preferably, the molecular weight distribution of the binder resin has at least one peak at a molecular weight of from 5,000 to 20,000. In the present disclosure, the molecular weight distribution of the binder resin is measured by gel permeation chromatography (GPC) using THF as a solvent.

When the binder resin is a polyester resin, the polyester resin preferably has an acid value of from 0.1 to 100 mgKOH/g, more preferably from 0.1 to 70 mgKOH/g, and most preferably from 0.1 to 50 mgKOH/g.

In the present disclosure, the acid value of the binder resin component in the toner composition is measured based on the following method according to JIS K-0070.

(1) A measurement sample is prepared by previously removing components other than the binder resin (polymer) component from the toner composition, or previously measuring the acid values and contents of the components other than the binder resin (polymer) content in the toner composition. The measurement sample, having been pulverized, in an amount of from 0.5 to 2.0 g is precisely weighed. This weight is identified as the polymer component weight W (g). For example, to measure the acid value of the binder resin in the toner, the acid values and contents of a colorant, a magnetic material, etc., should be previously measured so that the acid value of the binder resin can be calculated.

(2) The measurement sample is dissolved in 150 ml of a mixed liquid of toluene/ethanol (volume ratio: 4/1) in a 300-ml beaker.

(3) The resulting solution is subjected to a titration with a 0.1 mol/l ethanol solution of KOH using a potentiometric titrator.

(4) The consumed amount of the KOH solution in the titration is identified as S (ml). The consumed amount of the KOH solution in a blank titration is identified as B (ml). The acid value can be calculated from the following formula (B). In the formula (B), f represents the factor of KOH.

$$\text{Acid Value(mgKOH/g)}=[(S-B)\times f\times 5.61]/W \quad \text{(B)}$$

Both the binder resin and the toner composition containing the binder resin preferably have a glass transition temperature (Tg) of from 35° C. to 80° C., more preferably from 40° C. to 70° C.

When Tg is less than 35° C., the toner may deteriorate in a high-temperature atmosphere. When Tg is greater than 80° C., the fixability of the toner may deteriorate.

The type of the binder resin can be properly selected depending on the types of organic solvent and release agent to be used in combination. When a release agent which is well soluble in an organic solvent is used, the softening point of the toner may be reduced. In such a case, the weight average molecular weight of the binder resin should be increased to increase the softening point of the binder resin and enhance hot offset resistance of the toner.

Colorant

Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these colorants can be used in combination.

The content of the colorant in the toner is preferably from 1% to 15% by weight and more preferably from 3% to 10% by weight.

The colorant can be combined with a resin to be used as a master batch.

Specific examples of the resin for use in the master batch include, but are not limited to, modified or unmodified polyester resin, polymers of styrene and derivatives thereof (e.g., polystyrene, poly-p-chlorostyrene, polyvinyl toluene), styrene copolymers (e.g., styrene-p-chlorostyrene copolymer, styrene-propylene copolymer, styrene-vinyl toluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Two or more of these resins can be used in combination.

The master batch can be obtained by mixing and kneading a resin and a colorant while applying a high shearing force.

To increase the interaction between the colorant and the resin, an organic solvent can be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried.

When performing the mixing or kneading, a high shearing force dispersing device such as a three roll mill can be preferably used.

The content of the master batch is preferably from 0.1 to 20 parts by weight based on 100 parts by weight of the binder resin.

The resin for the master batch preferably has an acid value of 30 mgKOH/g or less and an amine value of from 1 to 100. More preferably, the acid value is from 20 mgKOH/g or less and the amine value is from 10 to 50.

When the acid value exceeds 30 mgKOH/g or less, the chargeability may deteriorate even under high-humidity conditions and colorant dispersibility may become insufficient. When the amine value is less than 1 or greater than 100, colorant dispersibility may become insufficient.

The acid value can be measured based on a method according to JIS K-0070. The amine value can be measured based on a method according to JIS K-7237.

Colorant Dispersion Liquid

The colorant can be used as a colorant dispersion liquid.

Any colorant dispersant can be used. Dispersants having high affinity for the binder resin are preferable from the viewpoint of colorant dispersibility. Specific examples of such dispersants include, but are not limited to, commercially available dispersants such as AJISPER PB821 and PB822 (from Ajinomoto Fine-Techno Co., Inc.), DISPERBYK-2001 (from BYK-Chemie GmbH), and EFKA-4010 (from EFKA).

The colorant dispersant preferably has a weight average molecular weight of from 500 to 100,000, which is a styrene-converted local maximum molecular weight at which the main peak is observed in a molecular weight distribution chart obtained by gel permeation chromatography. From the viewpoint of colorant dispersibility, the molecular weight is more preferably from 3,000 to 100,000, much more preferably from 5,000 to 50,000, and most preferably from 5,000 to 30,000. When the molecular weight is less than 500, the polarity is so high that the colorant dispersibility may deteriorate. When the molecular weight exceeds 100,000, the affinity for the solvent is so high that the colorant dispersibility may deteriorate.

The addition amount of the colorant dispersant is preferably from 1 to 200 parts by weight, more preferably from 5 to 80 parts by weight, based on 100 parts by weight of the colorant. When the addition amount is less than 1 part by weight, colorant dispersibility may deteriorate. When the addition amount exceeds 200 parts by weight, chargeability may deteriorate.

Release Agent

Specific examples of the release agent include, but are not limited to, aliphatic hydrocarbon waxes (e.g., low-molecular-weight polyethylene, low-molecular-weight polypropylene, polyolefin wax, microcrystalline wax, paraffin wax, SASOL wax), oxides of aliphatic hydrocarbon waxes (e.g., oxidized polyethylene wax) and block copolymers thereof, plant waxes (e.g., candelilla wax, carnauba wax, sumac wax, jojoba wax), animal waxes (e.g., bees wax, lanolin, spermaceti), mineral waxes (e.g., ozokerite, ceresin, petrolatum), waxes mainly composed of fatty acid esters (e.g., montanate wax, castor wax), synthetic ester waxes, and synthetic amide waxes.

Specific examples of the release agents further include, but are not limited to, saturated straight-chain fatty acids (e.g., palmitic acid, stearic acid, montanic acid, straight-chain alkylcarboxylic acids), unsaturated fatty acids (e.g., brassidic acid, eleostearic acid, parinaric acid), saturated alcohols (e.g., stearyl alcohol, eicosyl alcohol, behenyl alcohol, carnaubyl alcohol, ceryl alcohol, melissyl alcohol, long-chain alkyl alcohol), polyols (e.g., sorbitol), fatty acid amides (e.g., linoleic acid amide, olefin acid amide, lauric acid amide), saturated fatty acid bisamides (e.g., methylenebis capric acid amide, ethylenebis lauric acid amide, hexamethylenebis stearic acid amide), unsaturated fatty acid amides (e.g., ethylenebis oleic acid amide, hexamethylenebis oleic acid amide, N,N'-dioleyl adipic acid amide, N,N'-dioleyl sebacic acid amide), aromatic bisamides (e.g., m-xylenebis stearic acid amide, N,N-distearyl isophthalic acid amide), metal salts of fatty acids (e.g., calcium stearate, calcium laurate, zinc stearate, magnesium stearate), aliphatic hydrocarbon waxes to which a vinyl monomer such as styrene and an acrylic acid is grafted, partial ester compounds of a fatty acid with a polyol (e.g., behenic acid monoglyceride), and methyl ester compounds having a hydroxyl group obtained by hydrogenating plant fats.

The above release agents which have been further subjected to a press sweating method, a solvent method, a recrystallization method, a vacuum distillation method, a supercritical gas extraction method, or a solution crystallization method, so as to more narrow the molecular weight distribution thereof, are also usable. Further, the above release agents from which impurities such as low-molecular-weight solid fatty acids, low-molecular-weight solid alcohols, and low-molecular-weight solid compounds have been removed are also usable.

The release agent preferably has a melting point of 65° C. or more, more preferably from 69° C. to 120° C., to balance fixability and offset resistance. When the melting point is 65° C. or more, the blocking resistance may not deteriorate. When the melting point is 120° C. or less, sufficient offset resistance is provided.

The melting point of the release agent is defined as a temperature at which the maximum endothermic peak is observed in an endothermic curve of the release agent measured by differential scanning calorimetry (DSC).

Preferably, the melting point of the release agent or toner is measured with a high-precision inner-heat power-compensation differential scanning calorimeter based on a method according to ASTM D3418-82. The endothermic curve is obtained by preliminarily heating and cooling a sample and then heating the sample at a heating rate of 10° C./min.

The content of the release agent is determined depending on the melt viscoelasticity of the binder resin and/or the fixing method, and is preferably from 1 to 50 parts by weight based on 100 parts by weight of the binder resin.

Charge Controlling Agent

Specific examples of the charge controlling agent include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives. Usable commercially available charge controlling agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complexes of quaternary ammonium salts), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salts), which are manufactured by Hoechst AG; LRA-901, and LR-147 (boron complex), which are manufactured by Japan Carlit Co., Ltd.; and copper phthalocyanine, perylene, quinacridone, azo pigments, and polymers having a functional group such as a sulfonate group, a carboxyl group, and a quaternary ammonium group, phenol resins, and fluorine-based compounds.

The used amount of the charge controlling agent is determined depending on the kind of the binder resin, existence or non-existence of an additive, the toner production method including its dispersion method, etc., and is not limited to a particular value. The used amount of the charge controlling agent is preferably from 0.1 to 10 parts by weight, more preferably from 0.2 to 5 parts by weight, based on 100 parts by weight of the binder resin. When the used amount of the charge controlling agent exceeds 10 parts by weight, the toner fixability may be inhibited.

From the viewpoint of production stability, the charge controlling agent is preferably used in a state being dissolved in an organic solvent. Alternatively, the charge controlling agent can be used in a state being finely dispersed in an organic solvent by a bead mill.

Toner

The toner preferably has a volume average particle diameter of from 1 to 8 μm so as to form high-resolution high-definition high-quality image.

The particle size distribution (i.e., the ratio of the volume average particle diameter to the number average particle diameter) of the toner is preferably from 1.00 to 1.15 so as to produce reliable image for an extended period of time.

In particular, the toner has a volume-based particle size distribution in which a second peak is observed at a particle diameter 1.21 to 1.31 times the model diameter. When the second peak does not exist, and especially when the ratio of the volume average particle diameter to the number average particle diameter is close to 1.00 (i.e., monodisperse), it means that the toner is very likely to take a close-packing structure, which causes degradation in initial flowability and cleanability. When a peak exists at a particle diameter greater than 1.31 times the model diameter, it means that the toner includes a large amount of coarse particles that degrade image granularity.

The toner may further include a flowability improver and/or a cleanability improver on its surface, if needed.

Flowability Improver

The toner may include a flowability improver. The flowability improver improves flowability of the toner by existing at the surface of the toner.

Specific examples of the flowability improver include, but are not limited to, a fine powder of silica prepared by a wet process or a dry process; fine powders of metal oxides such as titanium oxide and alumina; and fine powders of silica, titanium oxide, and alumina which are surface-treated with a silane-coupling agent, a titanium-coupling agent, or a silicone oil; and fine powders of fluorocarbon resins such as vinylidene fluoride and polytetrafluoroethylene. Among these materials, fine powders of silica, titanium oxide, and alumina are preferable. In addition, a fine powder of silica which is surface-treated with a silane-coupling agent or a silicone oil is preferable.

The flowability improver preferably has an average primary particle diameter of from 0.001 to 2 μm and more preferably from 0.002 to 0.2 μm.

The fine powder of silica can be obtained by gas phase oxidation of a silicon halide, and is generally called as dry-method silica or fumed silica.

Specific examples of commercially available fine powder of silica obtained by gas phase oxidation of a silicon halide include, but are not limited to, AEROSIL-130, -300, -380, -TT600, -MOX170, -MOX80, and -COK84 (from Nippon Aerosil Co., Ltd.); CAB-O-SIL -M-5, -MS-7, -MS-75, -HS-5, and -EH-5 (from Cabot Corporation); WACKER HDK-N20V15, -N20E, -T30, and -T40 (from Wacker Chemie AG); D-C Fine Silica (from Dow Corning Corporation); and Fransol (from Fransil).

In addition, a fine powder of hydrophobized silica, obtained by hydrophobizing the fine powder of silica obtained by gas phase oxidation of a silicon halide, is also preferable. The hydrophobized silica preferably has a hydrophobicity degree of from 30% to 80% measured by a methanol titration test. Hydrophobicity is given by chemically or physically treating a fine powder of silica with a material which is reactive with or adsorptive to the silica, such as an organic silicon compound. Treating the fine powder of silica obtained by gas phase oxidation of a silicon halide with an organic silicon compound is preferable.

Specific examples of the organic silicon compound include, but are not limited to, hydroxypropyltrimethoxysilane, phenyltrimethoxysilane, n-hexadecyltrimethoxysilane, n-octadecyltrimethoxysilane, vinylmethoxysilane, vinyltriethoxysilane, vinyltriacetoxysilane, dimethylvinylchlorosilane, divinylchlorosilane, γ-methacryloxypropyltrimethoxysilane, hexamethyldisilane, trimethylsilane, trimethylchlorosilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilyl acrylate, vinylmethylacetoxysilane, dimethylethoxysilane, trimethylethoxysilane, trimethylmethoxysilane, methyltriethoxysilane, isobutyltrimethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and 0 or 1 hydroxyl group bonded to Si in each terminal unit. Other than the above compounds, silicone oils such as dimethyl silicone oil are also usable. Two or more of these compounds can be used in combination.

The flowability improver preferably has a number average particle diameter of from 5 to 100 nm and more preferably from 5 to 50 nm.

The flowability improver preferably has a specific surface area of from 30 $m^2/g$ or more, more preferably from 60 to 400 $m^2/g$, measured by the BET method employing nitrogen adsorption.

When the flowability improver is a surface-treated powder, the fluidity improver preferably has a specific surface area of 20 $m^2/g$ or more, more preferably from 40 to 300 $m^2/g$, measured by the BET method employing nitrogen adsorption.

The used amount of the flowability improver is preferably from 0.03 to 8 parts by weight based on 100 parts by weight of the toner.

Cleanability Improver

The cleanability improver improves removability of residual toner particles remaining on an electrostatic latent image bearer or primary transfer medium after a toner image has been transferred therefrom onto a recording medium. Specific examples of the cleanability improver include, but are not limited to, metal salts of fatty acids (e.g., zinc stearate, calcium stearate) and fine particles of polymers prepared by soap-free emulsion polymerization (e.g., polymethyl methacrylate, polystyrene). Preferably, the fine particles of polymers have a relatively narrow size distribution and a volume average particle diameter of from 0.01 to 1 μm.

The flowability improver and cleanability improver are adhered to or fixed on the surface of the toner. Therefore, they are collectively called as external additives. The external additives can be added to the toner by, for example, a powder mixer. Specific examples of the powder mixer include, but are not limited to, V-type mixer, Rocking mixer, Loedige mixer, Nauta mixer, and Henschel mixer. Specific examples of the powder mixer which has a function of fixing the external additives to the toner include, but are not limited to, HYBRIDIZER, MECHANOFUSION®, and Q-TYPE MIXER.

Developer

In accordance with some embodiments of the present invention, the toner can be used for either one-component developer or two-component developer. The toner can be mixed with a carrier to be used as the two-component developer.

Carrier

Specific examples of the carrier include, but are not limited to, a ferrite carrier, a magnetite carrier, and a resin-coated carrier. The resin-coated carrier is composed of a core particle and a covering material that is a resin covering the core particle. Specific examples of the covering material include, but are not limited to, a styrene-acrylic resin (e.g., styrene-acrylate copolymer, styrene-methacrylate copolymer), an acrylic resin (e.g., acrylate copolymer, methacrylate copolymer), a fluorine-containing resin (e.g., polytetrafluoroethylene, monochlorotrifluoroethylene polymer, polyvinylidene fluoride), a silicone resin, a polyester resin, a polyamide resin, a polyvinyl butyral resin, and an aminoacrylate resin. In addition, an ionomer resin and a polyphenylene sulfide resin are also usable. Two or more of these resins can be used in combination.

Specific examples of the carrier further include a binder-type carrier in which a magnetic powder is dispersed in a resin. With respect to the resin-coated carrier, the surface of the core particle is covered with the resin (covering material) by a method such that the resin is dissolved or suspended in a solvent and then the solution or suspension is applied to the core particle, or the resin and the core particle are merely mixed in a powder state. The content ratio of the covering material is preferably from 0.01% to 5% by weight, more preferably from 0.1% to 1% by weight, based on 100 parts by weight of the resin-coated carrier.

Specific examples the carrier in which a magnetic material is covered with a mixture of two or more types of covering materials include, but are not limited to, the following.

(1) A titanium oxide powder in an amount of 100 parts by weight treated with a mixture of methyldichlorosilane and dimethyl silicone oil (at a weight ratio of 1:5) in an amount of 12 parts by weight.

(2) A silica powder in an amount of 100 parts by weight treated with a mixture of dimethyldichlorosilane and dimethyl silicone oil (at a weight ratio of 1:5) in an amount of 20 parts by weight.

Specific examples of the covering material further include, but are not limited to, a styrene-methyl methacrylate copolymer, a mixture of a fluorine-containing resin and a styrene copolymer, and a silicone resin. Among these resins, a silicone resin is preferable.

Specific examples of the mixture of a fluorine-containing resin and a styrene copolymer include, but are not limited to, a mixture of a polyvinylidene fluoride and a styrene-methyl methacrylate copolymer; a mixture of polytetrafluoroethylene and a styrene-methyl methacrylate copolymer; and a mixture of a vinylidene fluoride-tetrafluoroethylene copolymer (at a copolymerization weight ratio of from 10:90 to 90:10), a styrene-2-ethylhexyl acrylate copolymer (at a copolymerization weight ratio of from 10:90 to 90:10), and a styrene-2-ethylhexyl acrylate-methyl methacrylate copolymer (at a copolymerization weight ratio of from 20:60:5 to 30:10:50). Specific examples of the silicone resin include, but are not limited to, a nitrogen-containing silicon resin and a modified silicone resin obtained by reacting a nitrogen-containing silane-coupling agent with a silicone resin.

Specific magnetic materials usable as the core particle include, but are not limited to, an oxide (e.g., ferrite, iron-excess ferrite, magnetite, γ-iron oxide), a metal (e.g., iron, cobalt, nickel), and an alloy thereof. These magnetic materials may include an element such as iron, cobalt, nickel, aluminum, copper, lead, magnesium, tin, zinc, antimony, beryllium, bismuth, calcium, manganese, selenium, titanium, tungsten, and vanadium. Among these magnetic materials, a copper-zinc-iron ferrite composed primarily of copper, zinc, and iron, and a manganese-magnesium-iron ferrite composed primarily of manganese, magnesium, and iron are preferable.

Depending on the surface roughness of the carrier and the content of the covering material, the carrier preferably has a volume resistivity of from $10^6$ to $10^{10}$ Ω·cm. The carrier preferably has a particle diameter of from 4 to 200 μm, more preferably from 10 to 150 μm, and most preferably from 20 to 100 μm. In particular, the resin-coated carrier preferably has a 50% particle diameter of from 20 to 70 μm. The two-component developer preferably contains the toner in an amount of from 1 to 200 parts by weight, more preferably from 2 to 50 parts by weight, per 100 parts by weight of the carrier.

In a developing method using the toner according to an embodiment of the present invention, any electrophotographic electrostatic latent image bearer can be used. For example, an organic electrostatic latent image bearer, an amorphous silica electrostatic latent image bearer, a selenium electrostatic latent image bearer, and a zinc oxide electrostatic latent image bearer are preferable.

Method of Manufacturing Toner

One example of the method of manufacturing the toner is described below.

The toner according to an embodiment of the present invention can be obtained through the processes of: forming liquid droplets by discharging a toner composition liquid in which the binder resin and the release agent are dissolved or dispersed in a solvent; and solidifying the liquid droplets into fine particles.

Specific examples of the release agent include, but are not limited to, a wax. Here, the wax is required to be soluble in the toner composition liquid. Hence, a wax which is soluble in the solvent of the toner composition should be used.

It is possible that the release agent is dissolved in the solvent or the toner composition liquid by application of heat. To achieve stable continuous discharge, the temperature of the toner composition liquid is less than [Tb-20]° C., where Tb represents the boiling point of the solvent, during the process of solidifying the liquid droplets.

When the temperature of the solvent is less than [Tb-20]° C., generation of bubbles due to vaporization of the solvent in a toner composition liquid chamber or narrowing of discharge holes due to drying-out of the toner composition liquid near the discharge holes are prevented and stable discharge can be achieved.

To prevent the release agent from clogging the discharge holes, the release agent needs to be dissolved in the toner composition liquid. At the same time, the release agent is also required to be dissolved in the binder resin being dissolved in the toner composition liquid without causing phase separation, to obtain uniform toner particles. It is also required that the binder resin and the release agent are phase-separated in the resultant toner particles from which the solvent has been removed, so that the toner can exert releasability when being fixed to prevent the occurrence of the offset phenomenon. In case that the release agent and the binder resin are not phase-separated in the toner particles, the toner cannot exert releasability. Moreover, the melt viscosity and elasticity of the binder resin are so decreased that the hot offset phenomenon is likely to occur.

Accordingly, the release agent should be selected depending on the kind of the solvent and binder resin in use.

Solvent

The solvent is not limited to any particular material so long as it is volatile and is capable of dissolving or dispersing the toner composition. Specific preferred examples of the solvent include, but are not limited to, an ether, a ketone, a hydrocarbon, and an alcohol. In particular, tetrahydrofuran (THF), acetone, methyl ethyl ketone (MEK), ethyl acetate, toluene, and water are more preferable. Two or more of these solvents can be used in combination.

Preparation of Toner Composition Liquid

The toner composition liquid can be prepared by dissolving or dispersing the toner composition in the solvent.

The toner composition is dissolved or dispersed in the solvent by means of a homomixer or a bead mill so that the dispersoids (e.g., a colorant) become finer than the opening diameter of the discharge holes and discharge hole clogging is prevented.

Preferably, the toner composition liquid has a solid content concentration of from 3% to 40% by weight. When the solid content concentration is less than 3% by weight, it is likely that the productivity decreases and the dispersoids (i.e., a colorant) settle out or aggregate. As a result, the composition of the toner particles may become nonuniform and the toner quality may degrade. When the solid content concentration exceeds 40% by weight, toner particles having a small particle diameter may not be obtained.

One example of an apparatus for manufacturing the toner according to an embodiment of the present invention is described in detail below with reference to FIGS. 3 to 9. The apparatus includes a liquid droplet discharge device and a liquid droplet solidification device.

Liquid Droplet Discharge Device

The liquid droplet discharge device is not limited to any particular device so long as the particle diameter distribution of the discharged liquid droplets is narrow. The liquid droplet discharge device is of several types: a single-fluid nozzle, a two-fluid nozzle, a film-vibration-type discharge device, a Rayleigh-fission-type discharge device, a liquid-vibration-type discharge device, and a liquid-column-resonance-type discharge device. The film-vibration-type liquid droplet discharge device is described in, for example, JP-2008-292976-A, the disclosure of which is incorporated herein by reference. The Rayleigh-fission-type liquid droplet discharge device is described in, for example, JP-4647506-B, the disclosure of which is incorporated herein by reference. The liquid-vibration-type liquid droplet discharge device is described in, for example, JP-2010-102195-A, the disclosure of which is incorporated herein by reference.

To narrow the particle diameter of liquid droplets and secure the productivity of the toner, the liquid-column-resonance-type discharge device is preferably used. In the liquid-column-resonance-type discharge device, a vibration is applied to a liquid contained in a liquid column resonance liquid chamber to form a liquid column resonant standing wave therein, and the liquid is discharged from multiple discharge holes formed within an area corresponding to antinodes of the liquid column resonant standing wave.

Liquid Column Resonance Liquid Droplet Discharge Device

One example of the liquid-column-resonance-type liquid droplet discharge device is described in detail below.

Figure 3:
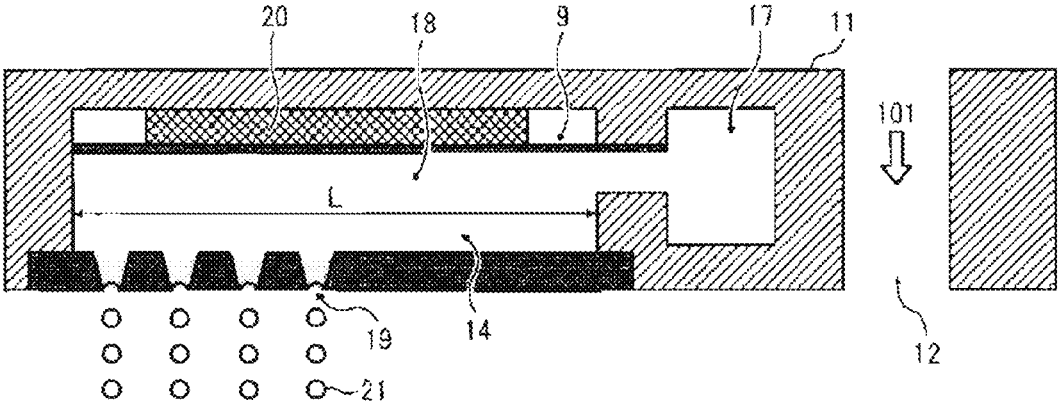
FIG. 3 is a cross-sectional view of a liquid column resonance liquid droplet forming device in accordance with some embodiments of the present invention.

FIG. 3 is a schematic view of a liquid column resonance liquid droplet discharge device 11. The liquid column resonance liquid droplet discharge device 11 has a liquid common supply path 17 and a liquid column resonance liquid chamber 18. The liquid column resonance liquid chamber 18 is communicated with the liquid common supply path 17 disposed on its one end wall surface in a longitudinal direction. The liquid column resonance liquid chamber 18 has discharge holes 19 to discharge liquid droplets 21, on its one wall surface which is connected with its both longitudinal end wall surfaces. The liquid column resonance liquid chamber 18 also has a vibration generator 20 to generate high-frequency vibration for forming a liquid column resonant standing wave, on the wall surface facing the discharge holes 19. The vibration generator 20 is connected to a high-frequency power source.

The liquid to be discharged from the liquid droplet discharge device may be, for example, a fine-particle-constituents-containing liquid in which constituents of fine particles to be obtained are dissolved or dispersed in a solvent. Since the liquid just has to be in a liquid state and does not necessarily include any solvent, the liquid may take a form of a fine-particle-constituents-melting liquid comprised of the constituents of fine particles to be obtained are in a melted state. Hereinafter both the fine-particle-constituents-containing liquid and the fine-particle-constituents-melting liquid are collectively referred to as the toner composition liquid.

Figure 4:
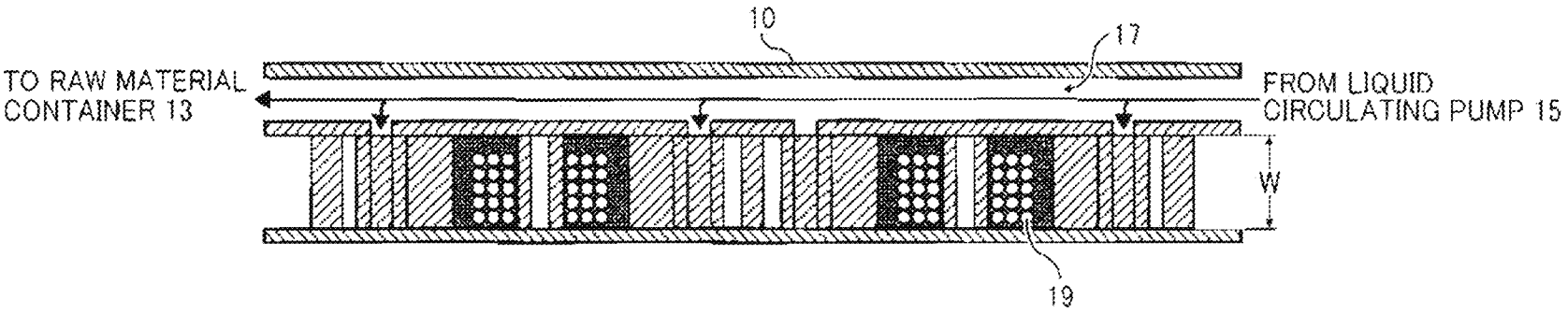
FIG. 4 is a cross-sectional view of a liquid droplet formation unit in accordance with some embodiments of the present invention.

A toner composition liquid 14 is flowed into the liquid common supply path 17 disposed within a liquid droplet formation unit 10, as illustrated in FIG. 4, through a liquid supply tube by a liquid circulating pump and is supplied to each liquid column resonance liquid chamber 18 disposed within the liquid column resonance liquid droplet discharge device 11. Within the liquid column resonance liquid chamber 18 filled with the toner composition liquid 14, the vibration generator 20 causes liquid column resonance and generates a pressure standing wave. Thus, a pressure distribution is formed therein. The liquid droplets 21 are discharged from the discharge holes 19 provided within an area corresponding to an antinode of the pressure standing wave, where the amplitude in pressure variation is large. The area corresponding to an antinode is defined as an area not corresponding to a node of the pressure standing wave. Preferably, the area corresponding to an antinode is an area where the amplitude in pressure variation of the standing wave is large enough to discharge liquid droplets. More preferably, the area corresponding to an antinode is an area extending from a position at a local maximum amplitude (i.e., a node of the velocity standing wave) toward a position at a local minimum amplitude for a distance±¼ of the wavelength of the pressure standing wave.

Within the area corresponding to an antinode of the pressure standing wave, even in a case in which multiple discharge holes are provided, each of the multiple discharge holes discharges uniform liquid droplets at a high degree of efficiency without causing clogging. After passing the liquid common supply path 17, the toner composition liquid 14 flows into a liquid return pipe and returns to a raw material container. As the liquid droplets 21 are discharged, the amount of the toner composition liquid 14 in the liquid column resonance liquid chamber 18 is reduced and a suction force generated by the action of the liquid column resonance standing wave is also reduced within the liquid column resonance liquid chamber 18. Thus, the liquid common supply path 17 temporarily increases the flow rate of the toner composition liquid 14 to fill the liquid column resonance liquid chamber 18 with the toner composition liquid 14. After the liquid column resonance liquid chamber 18 is refilled with the toner composition liquid 14, the flow rate of the toner composition liquid 14 in the liquid common supply path 17 is returned.

The liquid column resonance liquid chamber 18 may be formed of joined frames formed of a material having a high stiffness which does not adversely affect liquid resonant frequency of the liquid at drive frequency, such as metals, ceramics, and silicone. A length L between both longitudinal ends of the liquid column resonance liquid chamber 18 illustrated in FIG. 3 is determined based on a mechanism of liquid column resonance to be described in detail later. A width W of the liquid column resonance liquid chamber 18 illustrated in FIG. 4 may be smaller than a half of the length L of the liquid column resonance liquid chamber 18 so as not to give excessive frequency to the liquid column resonance. Preferably, a single liquid droplet formation unit 10 includes multiple liquid column resonance liquid chambers 18 to drastically improve productivity. The number of the liquid column resonance liquid chambers 18 in one liquid droplet formation unit 10 is not limited to any particular number, but when the number is from 100 to 2,000, operability and productivity go together, which is preferable. Each of the liquid column resonance liquid chambers 18 is communicated with the liquid common supply path 17 through each liquid supply path. The liquid common supply path 17 is communicated with multiple liquid column resonance liquid chambers 18.

The vibration generator 20 is not limited to any particular device so long as it can be driven at a predetermined frequency. For example, the vibration generator 20 may be formed from a piezoelectric body and an elastic plate 9 attached to each other. The elastic plate 9 constitutes a part of the wall of the liquid column resonance liquid chamber 18 so that the piezoelectric body does not contact the liquid. The piezoelectric body may be, for example, a piezoelectric ceramic such as lead zirconate titanate (PZT), which is generally laminated because of having a small displacement. Additionally, piezoelectric polymers such as polyvinylidene fluoride (PVDF), crystals, and single crystals of $LiNbO_3$, $LiTaO_3$, and $KNbO_3$ are also usable. Preferably, the vibration generator 20 in each liquid column resonance liquid chamber 18 is independently controllable. Alternatively, a single blockish vibrating material may be partially cut to fit the arrangement of the liquid column resonance liquid chambers 18 so that each liquid column resonance liquid chamber 18 is independently controllable through the elastic plate.

Each of the discharge holes 19 preferably has an outlet diameter (Dp) of from 1 to 40 μm. When Dp is less than 1 μm, the resulting liquid droplets may be too small to be used as a toner. In a case in which the liquid includes solid fine particles of toner constituents, such as pigments, the discharge holes 19 will be clogged frequently and the productivity will decrease. When Dp is greater than 40 μm, the diameter of each liquid droplets may be too large. In case such large liquid droplets are dried and solidified into toner particles having a desired particle diameter of from 3 to 6 μm, the toner composition needs to be diluted with an organic solvent, which requires a large amount of drying energy in obtaining a predetermined amount of toner. Arranging the discharge holes 19 in the width direction of the liquid column resonance liquid chamber 18, as illustrated in FIG. 4, is preferable because it is possible to arrange a large number of the discharge holes 19 and to improve production efficiency. The liquid column resonant frequency varies depending on the arrangement of the discharge holes 19. Thus, the liquid column resonant frequency may be varied in accordance with the nozzle arrangement and corresponding liquid droplets discharge condition.

The cross-sectional shape of each of the discharge holes 19 has a tapered shape such that the outlet diameter gets smaller, as illustrated in FIG. 3, but is not limited thereto.

A mechanism of liquid droplet formation in the liquid droplet formation unit 10 is described in detail below.

First, a mechanism of liquid column resonance generated in the liquid column resonance liquid chamber 18 in the liquid column resonance liquid droplet discharge device 11 is described.

The resonant wavelength λ is represented by the following formula (1):

$$\lambda = c/f \quad (1)$$

wherein c represents a sonic speed in the toner composition liquid in the liquid column resonance liquid chamber 18 and f represents a drive frequency given to the toner composition liquid from the vibration generator 20.

Referring to FIG. 3, L represents a length between the fixed end of the frame of the liquid column resonance liquid chamber 18 and the other end thereof closer to the liquid common supply path 17; h1 (e.g., about 80 μm) represents a height of the end of the frame of the liquid column resonance liquid chamber 18 closer to the liquid common supply path 17; and h2 (e.g., about 40 μm) represents a height of a communication opening between the liquid column resonance liquid chamber 18 and the liquid common supply path 17. The height h1 is about twice as much as the height h2. The end closer to the liquid common supply path 17 is equivalent to a fixed end. When both ends are fixed, resonance most effectively occurs when the length L is an even multiple of λ/4. In this case, the length L is represented by the following formula (2):

$$L = (N/4)\lambda \quad (2)$$

wherein N represents an even number.

The formula (2) is also satisfied when both ends of the liquid column resonance liquid chamber 18 are completely open or free.

Similarly, when one end is open or free so that pressure can be released and the other end is closed or fixed, resonance most effectively occurs when the length L is an odd multiple of λ/4. In this case, the length L is represented by the formula (2) as well, wherein N represents an odd number.

Thus, the most effective drive frequency f is derived from the formulae (1) and (2) and represented by the following formula (3):

$$f = N \times c/(4L) \quad (3)$$

Actually, vibration is not infinitely amplified because the liquid attenuates resonance due to its viscosity. Therefore, resonance can occur even at a frequency around the most effective drive frequency f represented by the formula (3), as shown in the later-described formula (4) or (5).

Figure 5A:
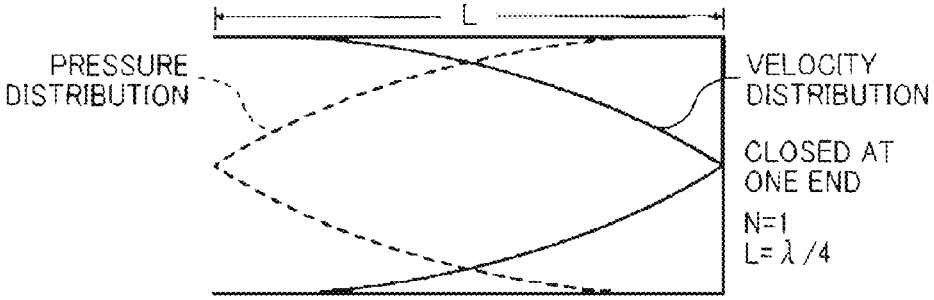
FIGS. 5A to 5D are schematic views of wave configurations of velocity and pressure standing waves when N is 1, 2, or 3.
Figure 5B:
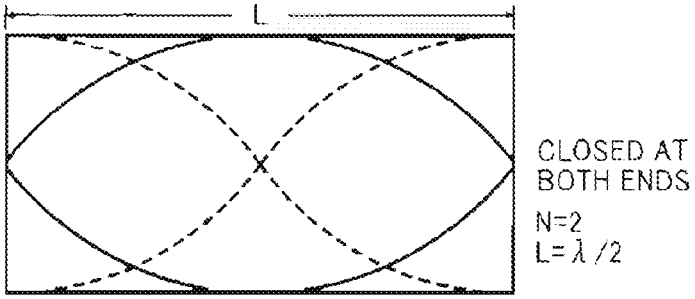
Figure 5C:
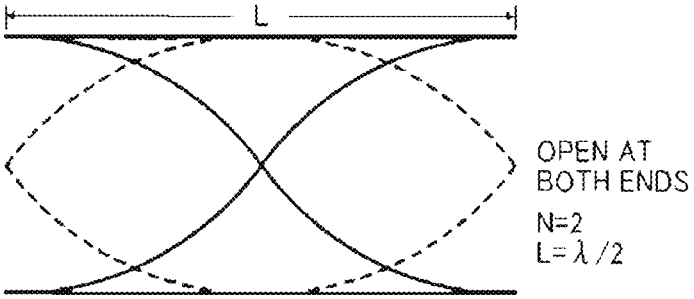
Figure 5D:
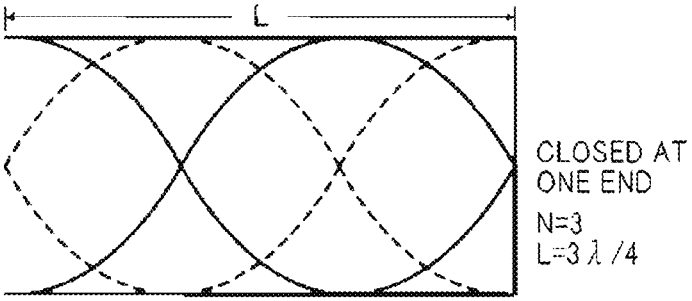
Figure 6A:
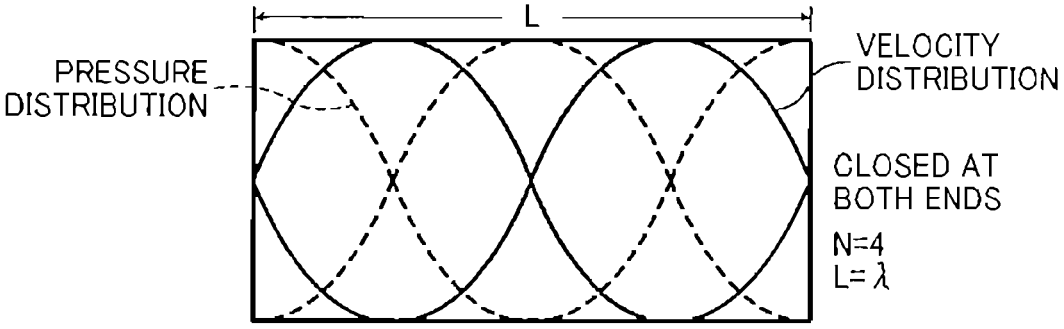
FIGS. 6A to 6C are schematic views of wave configurations of velocity and pressure standing waves when N is 4 or 5.
Figure 6B:
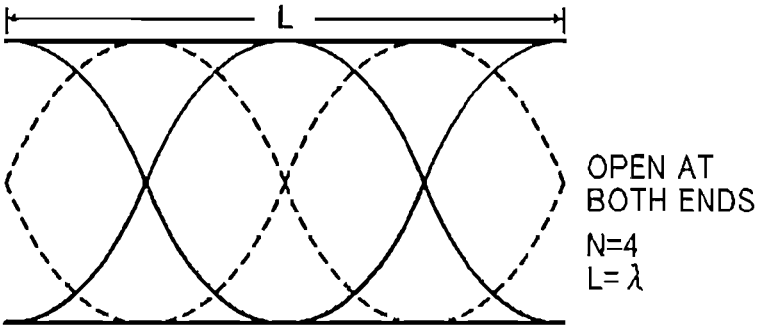
Figure 6C:
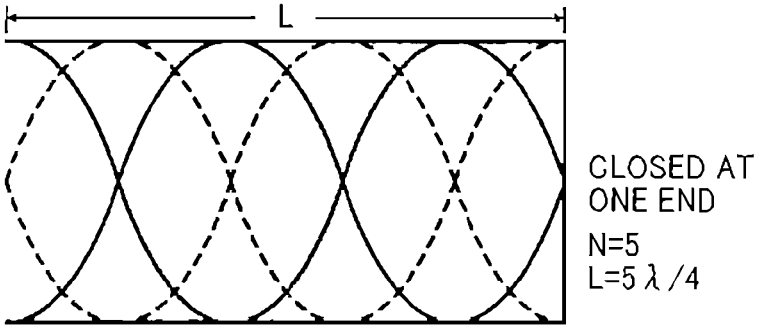

FIGS. 5A to 5D are views of wave configurations (i.e., resonant modes) of velocity and pressure standing waves when N is 1, 2, or 3. FIGS. 6A to 6C are views of wave configurations (i.e., resonant modes) of velocity and pressure standing waves when N is 4 or 5. The standing waves are longitudinal waves in actual but are generally illustrated as transversal waves as in FIGS. 5A to 5D and FIGS. 6A to 6C. In FIGS. 5A to 5D and FIGS. 6A to 6C, solid lines represent velocity standing waves and dotted lines represent pressure standing waves. For example, referring to FIG. 5A, it is intuitively understandable that when one end is closed and N is 1, amplitude of the velocity standing wave is zero at the closed end and is maximum at the open end. When L represents the length between both longitudinal ends of the liquid column resonance liquid chamber 18 and λ represents the liquid column resonant wavelength of the liquid, standing waves most effectively occur when the integer N is from 1 to 5. Wave configurations of the standing waves depend on whether or not either end is open or closed. The condition of either end depends on conditions of discharge holes and/or supply openings.

In acoustics, an open end is defined as a point at which longitudinal velocity of a medium (e.g., a liquid) is maximum and pressure thereof is zero. A closed end is defined as a point at which longitudinal velocity of the medium is zero. The closed end is acoustically considered as a hard wall that reflects waves. When each end is ideally completely closed or open, resonant standing waves as illustrated in FIGS. 5A to 5D and FIGS. 6A to 6C occur. Configurations of the standing waves vary depending on the number and/or arrangement of the discharge holes. Thus, resonant frequency can appear even at a position displaced from the position derived from the formula (3).

Even in such cases, stable discharge conditions can be provided by adjusting the drive frequency. For example, when the sonic speed c in the liquid is 1,200 m/s, the length L between both ends of the liquid column resonance liquid chamber 18 is 1.85 mm, both ends are fixed with wall surfaces, i.e., both ends are closed, and N is 2, the most effective resonant frequency is derived from the formula (3) as 324 kHz. As another example, when the sonic speed c in the liquid is 1,200 m/s, the length L between both ends of the liquid column resonance liquid chamber 18 is 1.85 mm, both ends are fixed with wall surfaces, i.e., both ends are closed, and N is 4, the most effective resonant frequency is derived from the formula (3) as 648 kHz. Thus, higher resonance can occur in the single liquid column resonance liquid chamber 18.

In the liquid column resonance liquid chamber 18 of the liquid column resonance liquid droplet discharge device 11 illustrated in FIG. 3, preferably, both ends are equivalent to closed ends or are regarded as being acoustically soft walls due to the influence of the discharge hole openings, to increase the frequency. Of course, both ends may be equivalent to open ends. The influence of the discharge hole openings means a lesser acoustic impedance and a greater compliance component. When the liquid column resonance liquid chamber 18 has wall surfaces on both longitudinal ends, as illustrated in FIG. 5B or FIG. 6A, all possible resonant modes are available as if both ends are closed or one end is open, which is preferable.

In particular, the drive frequency depends on the number, arrangement, and/or cross-sectional shape of the discharge holes 19. For example, as the number of the discharge holes 19 increases, closed ends of the liquid column resonance liquid chamber 18 are gradually released from restriction. As a result, a resonant standing wave is generated as if both ends are substantially open and the drive frequency is increased. The restriction releases from the position of one of the discharge holes 19 disposed closest to a liquid supply path 17. As another example, when each of the discharge holes 19 has a round cross-sectional shape or the volume of each discharge hole 19 is varied by varying the frame thickness, the actual standing wave has a short wavelength which has a higher frequency than the drive frequency. Upon application of voltage to the vibration generator 20 with the drive frequency thus determined, the vibration generator 20 deforms so as to generate a resonant standing wave most effectively. A liquid column resonance standing wave can generate even at a frequency around the most effective drive frequency for generating a resonant standing wave. When the vibration generator 20 vibrates at a drive frequency f satisfying the following formulae (4) and (5), a liquid column resonance is generated and liquid droplets are discharged from the discharge holes 19:

$$N\times c/(4L)\leq f\leq N\times c/(4Le) \quad (4)$$

$$N\times c/(4L)\leq f\leq (N+1)\times c/(4Le) \quad (5)$$

wherein L represents a length between both longitudinal ends of the liquid column resonance liquid chamber 18 and Le represents a distance between a longitudinal end of the liquid column resonance liquid chamber 18 closer to the liquid common supply path 17 and the discharge hole 19 closest to the longitudinal end.

It is preferable that an inequation Le/L>0.6 is satisfied.

Based on the above-described mechanism of liquid column resonance, a liquid column resonant pressure standing wave is formed in the liquid column resonance liquid chamber 18 illustrated in FIG. 3 and liquid droplets are continuously discharged from the discharge holes 19 disposed to a part of the liquid column resonance liquid chamber 18. When the discharge holes 19 are disposed at a position of the maximum amplitude of the pressure standing wave, discharge efficiency becomes maximum and low-voltage driving is allowed, which is preferable. The liquid column resonance liquid chamber 18 has at least one discharge hole 19, but preferably multiple discharge holes 19 to improve productivity. Preferably, the number of the discharge holes 19 per liquid column resonance liquid chamber 18 is from 2 to 100.

When the number of the discharge holes 19 per liquid column resonance liquid chamber 18 is 100 or less, a voltage to be applied to the vibration generator 20 in forming liquid droplets from the discharge holes 19 can be reduced and therefore the behavior of the piezoelectric body serving as the vibration generator 20 can be stabilized. Preferably, the interval between adjacent discharge holes 19 is 20 μm or more, and is equal to or less than the length of the liquid column resonance liquid chamber 18. When the interval is 20 μm or more, probability that liquid droplets discharged from adjacent discharge holes collide with each other and form a large liquid droplet can be reduced, resulting in production of toner particles having a proper particle size distribution.

Details of a liquid column resonance phenomenon occurring in the liquid column resonance liquid chamber 18 are described with reference to FIGS. 7A to 7D.

In FIGS. 7A to 7D, solid lines represent velocity distributions at arbitrary points in a longitudinal direction within the liquid column resonance liquid chamber 18. With respect to the velocity, the direction from the closed-end wall side (i.e., left side) toward the open-end wall side (i.e., right side) is defined as the plus (+) direction and the opposite direction is defined as the minus (−) direction. Dotted lines represent pressure distributions at arbitrary points in a longitudinal direction within the liquid column resonance liquid chamber 18. Positive and negative pressures relative to atmospheric pressure are respectively indicated as the plus (+) and minus (−) pressures in FIGS. 7A to 7D.

In FIGS. 6A to 6D, the height h1 (about 80 μm) of the end of the frame of the liquid column resonance liquid chamber 18 closer to the liquid common supply path 17 is about twice as the height h2 (about 40 μm) of the communication opening between the liquid column resonance liquid chamber 18 and the liquid common supply path 17. Therefore, it can be assumed that both longitudinal ends of the liquid column resonance liquid chamber 18 are approximately closed. Thus, FIGS. 7A to 7D represent temporary variations in velocity and pressure distributions under the assumption that both ends of the liquid column resonance liquid chamber 18 are approximately closed.

Figure 7A:
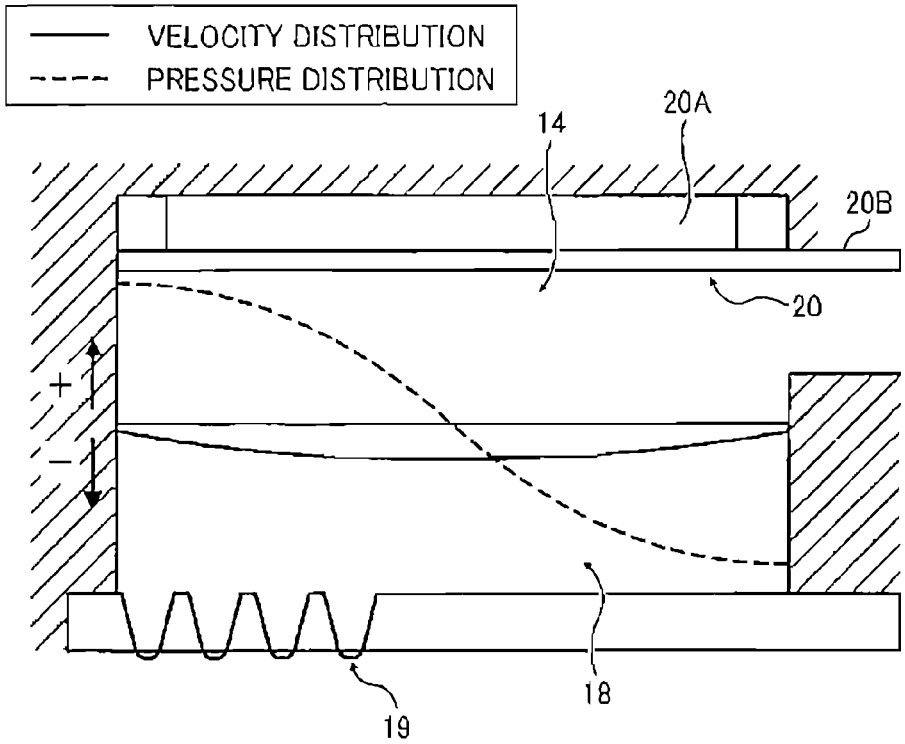
FIGS. 7A to 7D are schematic views illustrating a liquid column resonance phenomenon occurring in the liquid column resonance liquid droplet forming device.
Figure 7B:
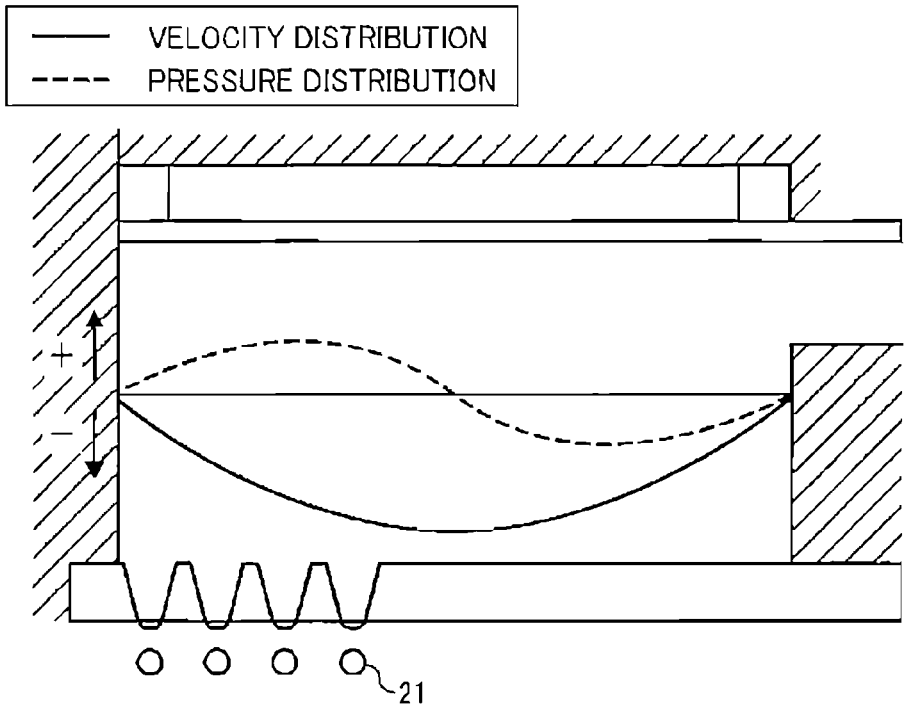

In FIG. 7A, pressure and velocity wave configurations within the liquid column resonance liquid chamber 18 are illustrated at the time that liquid droplets are being discharged. At this time, the pressure of the liquid becomes maximal at the closed-end wall side of the liquid column resonance liquid chamber 18, in other words, at the position where the discharge holes 19 are disposed. The meniscus pressure is thereby increased and the liquid comes out from the discharge holes 19. Thereafter, as illustrated in FIG. 7B, the pressure of the liquid around the discharge holes 19 decreases toward negative pressures, and liquid droplets 21 are discharged out from the discharge holes 19.

Figure 7C:
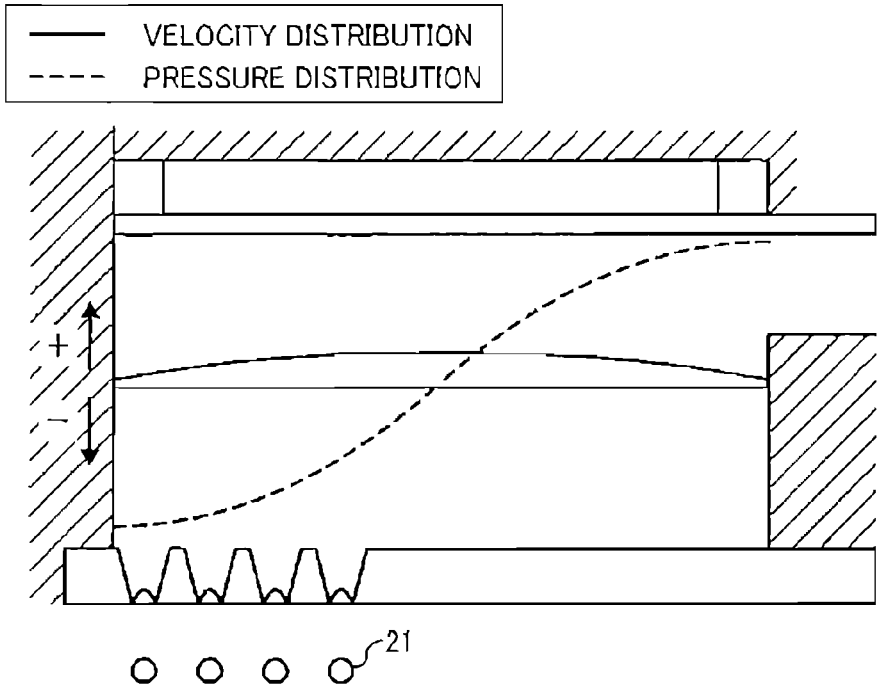
Figure 7D:
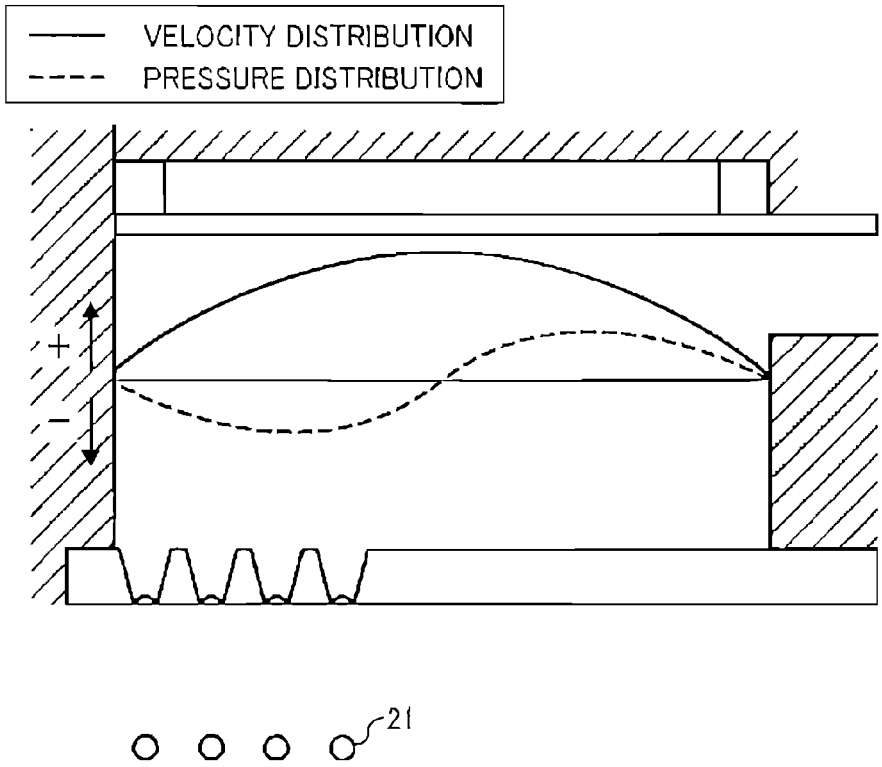

Thereafter, as illustrated in FIG. 7C, the pressure of the liquid around the discharge holes 19 becomes minimum. From this time, filling of the liquid column resonance liquid chamber 18 with the toner composition liquid 14 from the liquid common supply path 17 is started. Thereafter, as illustrated in FIG. 7D, the pressure of the liquid around the discharge holes 19 gradually increases toward positive pressures. At this time, the filling of the liquid column resonance liquid chamber 18 with the toner composition liquid 14 is terminated. The pressure of the liquid then becomes maximal at around the discharge holes 19 again as illustrated in FIG. 7A.

In summary, a liquid column resonant standing wave is generated in the liquid around the discharge holes 19 of the liquid column resonance liquid chamber 18 by a high-frequency driving of the generation vibrator 20. Since the discharge holes 19 are disposed to the position corresponding to antinodes of the standing wave at which the pressure amplitude becomes maximum, the toner liquid droplets 21 are continuously discharged from the discharge holes 19 in accordance with the period of the standing wave.

Solidification of Liquid Droplets

After the liquid droplet discharge device discharges liquid droplets of the toner composition liquid into a gas phase, the liquid droplets are solidified and collected.

Liquid Droplet Solidification Device

The method for solidifying the liquid droplets is selected depending on the nature of the toner composition liquid, and is not limited to a specific method so long as the toner composition liquid can be solidified.

For example, when the toner composition liquid is comprised of a volatile solvent in which solid raw materials are dissolved or dispersed, the discharged liquid droplets can be solidified by drying the liquid droplets, in other words, evaporating the solvent, in a carrier gas flow. The drying condition is controllable by controlling the temperature of the injection gas, vapor pressure, and kind of the gas. The liquid droplets need not necessarily be completely dried so long as the collected particles are kept in a solid state. In this case, the collected particles may be subject to an additional drying process. Alternatively, the drying can be achieved by means of temperature change, chemical reaction, etc.

In the process of solidifying the liquid droplets, the release agent recrystallizes and the crystal grows so that the inequation $0.45 \leq (S1/S2) \leq 1.00$ is satisfied. To achieve this, a first approach involves drying the liquid droplets under an atmosphere having a temperature of (Tc−5)° C. or more, where Tc represents the recrystallization temperature of the release agent. A second approach involves drying the liquid droplets in an environment where the relative humidity of the solvent in the toner composition liquid is adjusted to from 10% to 40%, even when the atmosphere has a temperature of (Tc−5)° C. or less. In either approach, the growth of the crystal domains can be accelerated by slowing the recrystallization rate of the release agent and/or the solvent drying rate.

The recrystallization temperature (Tc) of the release agent can be determined by differential scanning calorimetry (DSC). In the present disclosure, the recrystallization temperature (Tc) is defined as a temperature at which an exothermic peak is observed in a DSC curve obtained by heating a sample to 150° C. at a heating rate of 10° C./min and then cooling to 0° C. at a cooling rate of 10° C./min. When the temperature of the atmosphere is less than (Tc−5)° C., the crystallization rate increases and it becomes hard to form a release agent domain having a sufficient length or a branch.

In the second approach, when the relative humidity of the solvent of the toner composition liquid is less than 10%, the solvent drying rate increases and recrystallization of the release agent is accelerated. As a result, the release agent is likely to be formed into relatively small domains, which is not preferable. When the relative humidity of the solvent of the toner composition liquid exceeds 40%, the solvent drying rate becomes very slow and cohesion or coalescence of the toner particles is accelerated while being dried. Thus, it becomes difficult to obtain a toner having a desired particle size distribution.

To achieve the inequation $0.45 \leq (S1/S2) \leq 1.00$ by recrystallizing and growing the crystal of the release agent in the process of solidifying the liquid droplets, it is preferable that the difference in solubility parameter (ΔSP) between the binder resin and the release agent is adjusted to 2.1 or more, in addition to the adjustment of the temperature and humidity condition as described above. As ΔSP increases, the compatibility of the release agent with the binder resin decreases, and therefore recrystallization of the release agent is more accelerated and domains thereof become larger. The crystals of the release agent can spread over a wide area in the resulting toner particle while satisfying the inequation $0.45 \leq (S1/S2) \leq 1.00$.

In the present disclosure, solubility parameter (SP) is determined in the following manner.

First, an excessive amount of a sample is dissolved in 10 ml of several solvents (i.e., n-hexane, toluene, MEK, acetone, pyridine, and n-butanol) having different solubility parameters. Each solution is filtered with a 5-μm disposal filter. The filtered solution is dried at 40° C. The dried product is weighed to calculate the amount of dissolution of the sample.

A graph with SP value on the horizontal axis and the amount of dissolution of the sample on the vertical axis is drawn. The plotted data is approximated by a convex quadratic curve. An SP value at which a peak is observed in the curve is identified as a solubility parameter of the sample.

Preferably, two or more types of release agents having different melting points are used in combination. When only one type of release agent having a high melting point is used, the discharge holes may be partially clogged with time. As a result, it may be difficult for the liquid droplet discharge device to reliably discharge the toner composition liquid for an extended period of time. This problem can be effectively solved by reducing the amount of the release agent. However, reducing the amount of the release agent degrades the toner in terms of releasability and offset resistance, thereby causing an undesirable phenomenon that a paper sheet having a toner thereon winds around a fixing roller when the fixing temperature is high. On the other hand, when only one type pf release agent having a low melting point is used, the problems regarding discharge stability, hot offset resistance, and paper winding can be solved. However, when the toner is stirred for a long period of time accompanied by heat generation, it is likely that toner adherence is caused and image stability is degraded. The above problems can be effectively solved by using two or more types of release agents having different melting points in combination. At the same time, a good combination of discharge stability, releasability, and image stability is provided for an extended period of time.

Preferably, the two or more types of release agents each have a melting point of 65° C. or more, and the difference in melting point among the two or more types of release agents is 7° C. or more. When the difference in melting point is less than 7° C., releasability and/or image stability may deteriorate.

The melting point of each of the two or more types of release agents is defined as a temperature at which the maximum endothermic peak is observed in an endothermic curve of each release agent measured by differential scanning calorimetry (DSC). When two or more endothermic peaks or exothermic peaks are observed in a temperature-rising chart or temperature-descending chart, respectively, of the toner obtained by differential scanning calorimetry (DSC), it is confirmed that the toner includes two or more types of release agents.

In a case in which two or more types of release agents are used in combination, to achieve the inequation $0.45 \leq (S1/S2) \leq 1.00$ by means of crystal growth, the temperature and humidity condition should be adjusted in the same manner as described above. In addition, preferably, the difference in solubility parameter (ΔSP) between the binder resin and the release agent is adjusted to 2.1 or more. Here, the release agent which should be taken into consideration in determining the temperature, humidity, and solubility parameter conditions refers to that having the highest melting point among the two or more types of release agents. Specifically, the first approach in this case involves drying the liquid droplets under an atmosphere having a temperature of (Tc−5)° C. or more, where Tc represents the recrystallization temperature of the release agent having the highest melting point. In addition, the difference in solubility parameter (ΔSP) between the binder resin and the release agent having the highest melting point is preferably adjusted to 2.1 or more.

Solidified Particle Collector

The solidified particles can be collected by any powder collector, such as a cyclone collector or a back filter.

Figure 8:
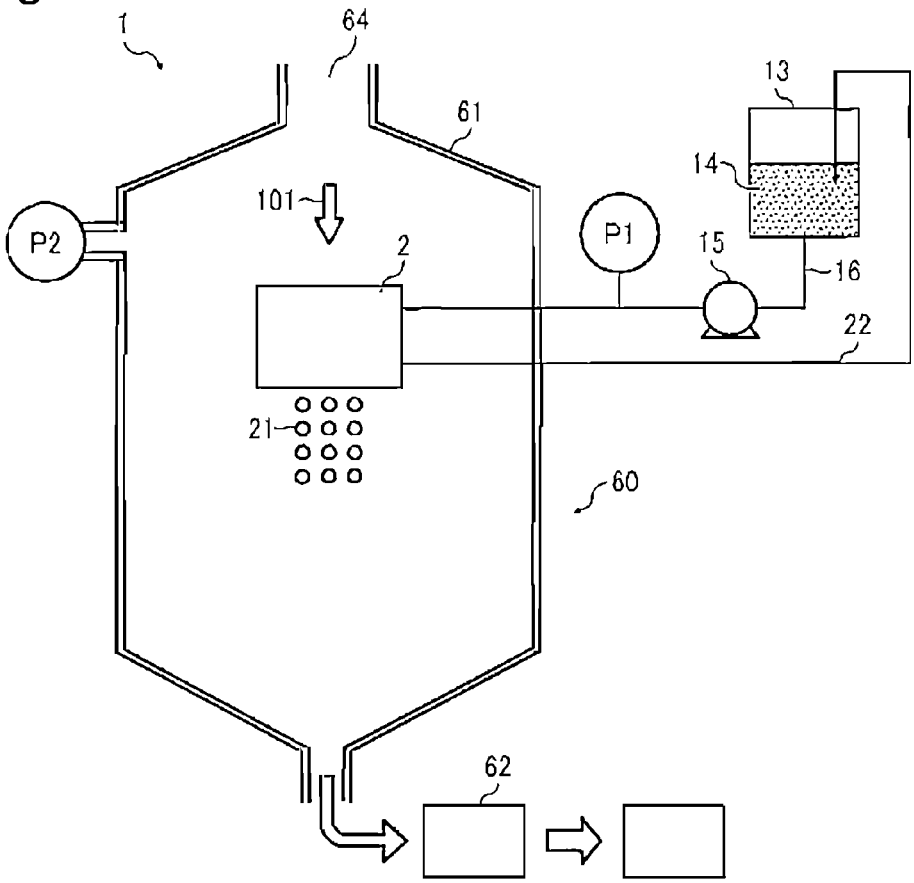
FIG. 8 is a cross-sectional view of an apparatus for manufacturing the toner in accordance with some embodiments of the present invention.

FIG. 8 is a cross-sectional view of an apparatus for manufacturing the toner according to an embodiment of the present invention. A toner manufacturing apparatus 1 has a liquid droplet discharge unit 2 and a drying collecting unit 60. The liquid droplet discharge device 2 is connected to a raw material container 13 containing the toner composition liquid 14 through a liquid supply pipe 16 to supply the toner composition liquid 14 from the raw material container 13 to the liquid droplet discharge device 2. The liquid droplet discharge device 2 is further connected to a liquid return pipe 22 to return the toner composition liquid 14 to the raw material container 13, and a liquid circulating pump 15 to pump the toner composition liquid 14 within the liquid supply pipe 16. Thus, the toner composition liquid 14 can be constantly supplied to the liquid droplet discharge device 2. The liquid supply pipe 16 and the drying collecting unit 60 are equipped with pressure gauges P1 and P2, respectively. The pressure gauges P1 and P2 monitor the liquid feed pressure toward the liquid droplet discharge device 2 and the inner pressure of the drying collecting unit 60, respectively. When the pressure measured by the pressure gauge P1 is greater than that measured by the pressure gauge P2 (i.e., P1>P2), there is a concern that the toner composition liquid 14 leaks from the discharge holes. When the pressure measured by the pressure gauge P1 is smaller than that measured by the pressure gauge P2 (i.e., P1<P2), there is a concern that a gas flows in the liquid droplet discharge device 2 and the liquid droplet discharge phenomenon is stopped. Thus, preferably, the pressure measured by the pressure gauge P1 is nearly identical to that measured by the pressure gauge P2.

Within a chamber 61, a descending conveyance airflow 101 is formed through a conveyance air current inlet 64. Liquid droplets 21 discharged from the liquid droplet discharge device 2 are conveyed downward by the action of gravity as well as the conveyance airflow 101 and collected by a solidified particle collector 62.

Conveyance Airflow

If the injected liquid droplets are brought into contact with each other before being dried, the liquid droplets coalesce with each other to form a single particle. (This phenomenon is hereinafter referred to as "coalescence".) To obtain solidified particles having a uniform particle diameter distribution, it is preferable that the distance between the injected liquid droplets is kept constant. Although the initial velocity is constant, the injected liquid droplet is gradually stalled due to air resistance. As a result, a posterior liquid droplet may catch up on and coalesce with the stalled particle. Because this phenomenon occurs constantly, the particle diameter distribution of the resulting collected particles may become undesirably wide. To prevent coalescence of liquid droplets, liquid droplets should be conveyed to the solidified particle collector 62 by the conveyance airflow 101 while being solidified without being stalled or brought into contact with each other.

Figure 9:
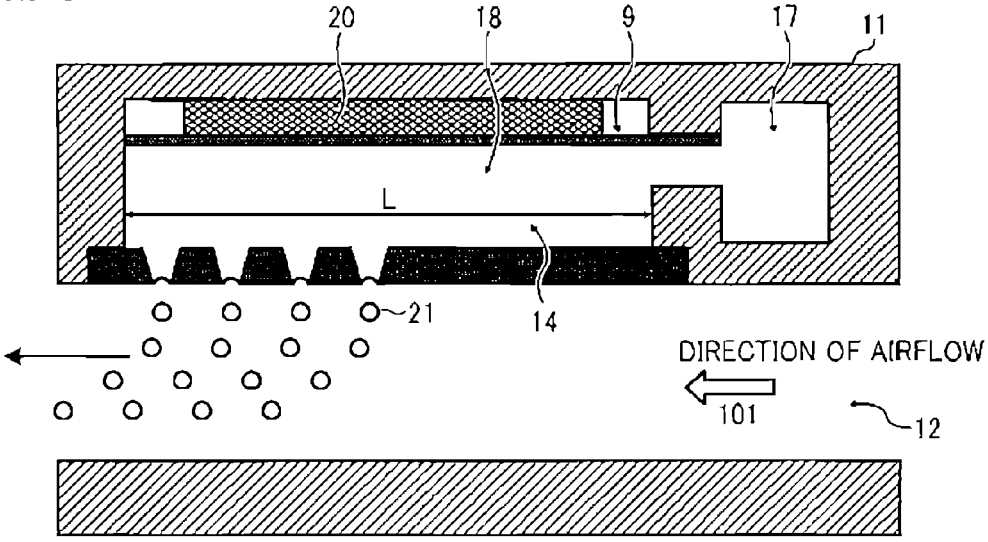
FIG. 9 is a cross-sectional view of a liquid column resonance liquid droplet forming device in accordance with some embodiments of the present invention.

Referring back to FIG. 3, a part of the conveyance airflow 101 (hereinafter maybe referred to as "first airflow") can flow near the liquid droplet discharge device 11 in the same direction as the direction of discharge of liquid droplets, so as to prevent speed decrease of the liquid droplets immediately after the discharge to prevent coalescence of the liquid droplets. Alternatively, the first airflow can flow in a direction lateral to the direction of discharge of liquid droplets, as illustrated in FIG. 9. Alternatively, the first airflow can flow at a certain angle with the liquid droplet discharge device 11 such that the liquid droplets are brought away from the liquid droplet discharge device 11. In a case in which the first airflow (hereinafter maybe referred to as "coalescence preventing airflow") flows in a direction lateral to the direction of discharge of liquid droplets, as illustrated in FIG. 9, it is preferable that the first airflow convey liquid droplets in a manner such that the travel path of each liquid droplet starting from any discharge hole will not intercept that of another liquid droplet.

It is also possible that coalescence of the liquid droplets is prevented by the first airflow and the solidified particles are conveyed to the toner collector by the second airflow.

It is preferable that the speed of the first airflow be equal to or more than the liquid droplet injection speed. If the speed of the first airflow is smaller than the liquid droplet injection speed, it is difficult for the first airflow (coalescence preventing airflow) to achieve its purpose, i.e., to prevent coalescence of the liquid droplets.

The first airflow can have any additional property for preventing coalescence of the liquid droplets and does not necessarily have the same property as the second airflow. In the first airflow (coalescence preventing airflow), a chemical substance which accelerates solidification of the liquid droplets can be mixed. Additionally, the first airflow (coalescence preventing airflow) can be physically treated to have a function of accelerating solidification of the liquid droplets.

The conveyance airflow 101 is not limited in condition, and may be, for example, a laminar flow, a swirl flow, or a turbulent flow. The conveyance airflow 101 is not limited in substance, and may be formed of, for example, the air or a noncombustible gas such as nitrogen. The temperature of the conveyance airflow 101 is variable but is preferably constant during the manufacturing operation. The chamber 61 may further include a unit for changing the condition of the conveyance airflow 101. The conveyance airflow 101 may prevent not only the coalescence of the liquid droplets 21 but also the adhesion of the liquid droplets 21 to the chamber 61.

Secondary Drying

When toner particles collected in the drying collecting unit 60 illustrated in FIG. 8 contain a large amount of residual solvent, the toner particles can be optionally subjected to a secondary drying to reduce the amount residual solvent. The secondary drying can be performed by any drier, such as a fluidized-bed drier or a vacuum drier. If residual solvent is remaining in the toner particles, toner properties such as heat-resistant storage stability, fixability, and chargeability may deteriorate with time. Moreover, when such toner particles are fixed on a recording material by application of heat, the solvent volatilizes with increasing a possibility of adversely affecting users and peripheral devices.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Example 1

Preparation of Toner 1

Preparation of Colorant Dispersion Liquid

A carbon black dispersion liquid is prepared as follows.

First, 20 parts of a carbon black (REGAL 400 from Cabot Corporation) and 2 parts of a colorant dispersant (AJISPER PB821 from Ajinomoto Fine-Techno Co., Inc.) are primarily dispersed in 78 parts of ethyl acetate using a mixer having stirrer blades. The resulting primary dispersion liquid is subjected to a dispersion treatment using a DYNOMILL to more finely disperse the carbon black and completely remove aggregations by application of a strong shearing force. The resulting secondary dispersion liquid is filtered with a polytetrafluoroethylene (PTFE) filter (Fluoropore™ Membrane Filter FHLP09050 available from Nihon Millipore K.K.) having a pore size of 0.45 μm to further disperse the carbon black to submicron range. Thus, a carbon black dispersion liquid is prepared.

Preparation of Toner Composition Liquid

First, 10 parts of a wax 1, serving as the release agent, and 273.3 parts of a polyester resin A, serving as the binder resin, are mixed and dissolved in 676.7 parts of ethyl acetate using a mixer having stirrer blades at 70° C.

Both the wax 1 and the polyester resin A are dissolved in the ethyl acetate without causing phase separation and a transparent liquid is obtained. After adjusting the temperature of the liquid to 55° C., 100 parts of the carbon black dispersion liquid are mixed therein and stirred for 10 minutes. Thus, a toner composition liquid is prepared.

The wax 1 is a synthetic amide wax having a melting point of 62.6° C. and a recrystallization temperature of 52.7° C. (available from NOF CORPORATION).

The polyester resin A is a binder resin composed of terephthalic acid, isophthalic acid, succinic acid, ethylene glycol, and neopentyl glycol, having a weight average molecular weight (Mw) of 24,000 and a glass transition temperature (Tg) of 60° C.

The weight average molecular weight (Mw) of the binder resin is determined by subjecting THF solubles in the binder resin to a measurement by a gel permeation chromatographic apparatus GPC-150C (available from Waters Corporation) equipped with Shodex® Columns KF801-807 (available from Showa Denko K. K.) and a refractive index (RI) detector. The boiling point of ethyl acetate is 76.8° C.

Preparation of Toner

A toner is prepared from the above-obtained toner composition liquid using the toner manufacturing apparatus illustrated in FIG. 8 having the liquid droplet discharge device illustrated in FIG. 3 as follows. First, liquid droplets of the toner composition liquid are discharged. The liquid droplets are dried and solidified by the liquid droplet solidification device using dry nitrogen. The solidified particles are collected by a cyclone collector and fan-dried at 35° C., 90% RH for 48 hours and at 40°, 50% RH for 24 hours. Thus, mother toner particles are obtained. The toner composition liquid and the members of the toner manufacturing apparatus which contact the toner composition liquid are temperature-controlled to 55° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the following criteria. The evaluation results for discharge stability are shown in Table 3.

Evaluation Criteria

AA: The rate of the clogged discharge holes is less the than 5%.

A: The rate of the clogged discharge holes is not less the than 5% and less than 15%.

B: The rate of the clogged discharge holes is not less the than 15% and less than 30%.

C: The rate of the clogged discharge holes is not less the than 30%.

Toner Preparation Conditions

Longitudinal length (L) of liquid column resonance liquid chamber: 1.85 mm

Diameter of discharge hole outlet: 8.0 μm

Drying temperature (nitrogen): 60° C.

Relative humidity of ethyl acetate (in nitrogen gas flow): 5%

Drive frequency: 340 kHz

Applied voltage to piezoelectric body: 10.0 V

Next, 100 parts of the mother toner particles are mixed with commercially-available silica powders, i.e., 2.8 parts of NAX50 (from Nippon Aerosil Co., Ltd., having an average primary diameter of 30 nm) and 0.9 parts of H20TM (from Clariant, having an average primary diameter of 20 nm), using a HENSCHEL MIXER. The mixture is sieved with a mesh having an opening of 60 μm to remove coarse particles and aggregations. Thus, a toner 1 is prepared.

The toner 1 is embedded in an epoxy resin and cut into ultrathin sections with an ultrasonic microtome. After being dyed with $RuO_4$, the ultrathin sections are observed with a transmission electron microscope (TEM). The obtained image is analyzed using an image analysis software program ImageJ to determine an area S1 of a quadrangle circumscribing a release agent domain and an area S2 of a quadrangle circumscribing a toner particle containing the release agent domain. Fifty randomly-selected toner particles are subjected to the measurement of s1/s2. The fifty s1/s2 values are average to determine S1/S2.

The content of the wax in the toner 1 is determined by converting the endothermic quantity of the wax measured by a differential scanning calorimetry (DSC) into weight. The amount of the wax existing in a region ranging from the surface to 0.3 μm in depth of the toner 1 is determined by an attenuated total reflection infrared spectroscopy (FTIR-ATR).

The particle size of the toner is also measured. The types of waxes and binder resins and toner manufacturing conditions are summarized in Table 1. The measurement results of toner properties are shown in Table 2.

Example 2

Preparation of Toner 2

The procedure in Example 1 is repeated except that the wax 1 is replaced with a wax 2, the drying temperature is changed to 65° C., and the relative humidity of ethyl acetate is changed to 6%. Thus, a toner 2 is prepared.

The wax 2 is a synthetic ester wax having a melting point of 70.3° C. and a recrystallization temperature of 64.1° C. (available from Nippon Seiro Co., Ltd.). Both the wax 2 and the polyester resin A are dissolved in the ethyl acetate without causing phase separation and a transparent liquid is obtained. The toner composition liquid and the members of the toner manufacturing apparatus which contact the toner composition liquid are temperature-controlled to 55° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the same criteria used in Example 1. The evaluation results for discharge stability are shown in Table 3.

The toner 2 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1.

The measurement results of toner properties are shown in Table 2.

Example 3

Preparation of Toner 3

The procedure in Example 1 is repeated except that the wax 1 is replaced with a wax 3. Thus, a toner 3 is prepared.

The wax 3 is a synthetic ester wax having a melting point of 75.2° C. and a recrystallization temperature of 64.3° C. (available from NOF CORPORATION).

Both the wax 3 and the polyester resin A are dissolved in the ethyl acetate without causing phase separation and a transparent liquid is obtained. The toner composition liquid and the members of the toner manufacturing apparatus which contact the toner composition liquid are temperature-controlled to 55° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the same criteria used in Example 1. The evaluation results for discharge stability are shown in Table 3.

The toner 3 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1.

The measurement results of toner properties are shown in Table 2.

Example 4

Preparation of Toner 4

The procedure in Example 1 is repeated except that the wax 1 is replaced with a wax 4 and the relative humidity of ethyl acetate is changed to 6%. Thus, a toner 4 is prepared.

The wax 4 is a synthetic ester wax having a melting point of 67.4° C. and a recrystallization temperature of 60.5° C. (available from NOF CORPORATION).

Both the wax 4 and the polyester resin A are dissolved in the ethyl acetate without causing phase separation and a transparent liquid is obtained. The toner composition liquid and the members of the toner manufacturing apparatus which contact the toner composition liquid are temperature-controlled to 55° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the same criteria used in Example 1. The evaluation results for discharge stability are shown in Table 3.

The toner 4 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1.

The measurement results of toner properties are shown in Table 2.

Example 5

Preparation of Toner 5

The procedure in Example 1 is repeated except that the wax 1 is replaced with a wax 5. Thus, a toner 5 is prepared.

The wax 5 is a synthetic ester wax having a melting point of 71.7° C. and a recrystallization temperature of 64.5° C. (available from NOF CORPORATION).

Both the wax 5 and the polyester resin A are dissolved in the ethyl acetate without causing phase separation and a transparent liquid is obtained. The toner composition liquid and the members of the toner manufacturing apparatus which contact the toner composition liquid are temperature-controlled to 55° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the same criteria used in Example 1. The evaluation results for discharge stability are shown in Table 3.

The toner 5 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1.

The measurement results of toner properties are shown in Table 2.

Example 6

Preparation of Toner 6

The procedure in Example 1 is repeated except that the wax 1 is replaced with a wax 5, the polyester resin A is replaced with a polyester resin B, the drying temperature is changed to 40° C., and the relative humidity of ethyl acetate is changed to 11%. Thus, a toner 6 is prepared.

The polyester resin B is a binder resin composed of terephthalic acid, isophthalic acid, ethylene glycol, and neopentyl glycol, having a weight average molecular weight (Mw) of 26,000 and a glass transition temperature (Tg) of 60° C.

Both the wax 5 and the polyester resin B are dissolved in the ethyl acetate without causing phase separation and a transparent liquid is obtained.

The toner 6 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1.

The measurement results of toner properties are shown in Table 2.

Example 7

Preparation of Toner 7

Preparation of Toner Composition Liquid

First, 10 parts of the wax 5, serving as the release agent, 215.6 parts of the polyester resin B and 57.7 parts of a styrene-acrylic resin A, both serving as the binder resin, are mixed and dissolved in 676.7 parts of ethyl acetate using a mixer having stirrer blades.

The wax 5, the polyester resin B, and the styrene-acrylic resin A are all dissolved in the ethyl acetate without causing phase separation and a transparent liquid is obtained. After adjusting the temperature of the liquid to 50° C., 100 parts of the carbon black dispersion liquid are mixed therein and stirred for 10 minutes. Thus, a toner composition liquid is prepared.

The styrene-acrylic resin A is a copolymer resin composed of styrene and butyl acrylate, having a glass transition temperature (Tg) of 62° C.

Preparation of Toner

A toner is prepared from the above-obtained toner composition liquid using the toner manufacturing apparatus illustrated in FIG. 8 having the liquid droplet discharge device illustrated in FIG. 3 as follows. First, liquid droplets of the toner composition liquid are discharged. The liquid droplets are dried and solidified by the liquid droplet solidification device using dry nitrogen. The solidified particles are collected by a cyclone collector and fan-dried at 35° C., 90% RH for 48 hours, at 40°, 50% RH for 24 hours, and 50°, 50% RH for 24 hours. Thus, mother toner particles are obtained. The toner composition liquid and the members of the toner manufacturing apparatus which contact the toner composition liquid are temperature-controlled to 50° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the same criteria used in Example 1. The evaluation results for discharge stability are shown in Table 3.

Toner Preparation Conditions

Longitudinal length (L) of liquid column resonance liquid chamber: 1.85 mm

Diameter of discharge hole outlet: 8.0 μm

Drying temperature (nitrogen): 40° C.

Relative humidity of ethyl acetate (in nitrogen gas flow): 40%

Drive frequency: 340 kHz

Applied voltage to piezoelectric body: 10.0 V

The mother toner particles are mixed with external additives in the same manner as Example 1. Thus, a toner 7 is prepared.

The toner 7 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1.

The measurement results of toner properties are shown in Table 2.

Example 8

Preparation of Toner 8

Preparation of Toner Composition Liquid

First, 10 parts of a wax 6, serving as the release agent, 273.3 parts of the styrene-acrylic resin A, serving as the binder resin, are mixed and dissolved in 676.7 parts of toluene using a mixer having stirrer blades.

Both the wax 6 and the styrene-acrylic resin A are dissolved in the toluene without causing phase separation and a transparent liquid is obtained. After adjusting the temperature of the liquid to 45° C., 100 parts of the carbon black dispersion liquid are mixed therein and stirred for 10 minutes. Thus, a toner composition liquid is prepared.

The wax 6 is a paraffin wax having a melting point of 74.1° C. and a recrystallization temperature of 70.1° C. (available from Nippon Seiro Co., Ltd.).

Preparation of Toner

A toner is prepared from the above-obtained toner composition liquid using the toner manufacturing apparatus illustrated in FIG. 8 having the liquid droplet discharge device illustrated in FIG. 3 as follows. First, liquid droplets of the toner composition liquid are discharged. The liquid droplets are dried and solidified by the liquid droplet solidification device using dry nitrogen. The solidified particles are collected by a cyclone collector and fan-dried at 35° C., 90% RH for 48 hours, at 40°, 50% RH for 24 hours, and 50°, 50% RH for 24 hours. Thus, mother toner particles are obtained. The toner composition liquid and the members of the toner manufacturing apparatus which contact the toner composition liquid are temperature-controlled to 45° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the same criteria used in Example 1. The evaluation results for discharge stability are shown in Table 3.

Toner Preparation Conditions

Longitudinal length (L) of liquid column resonance liquid chamber: 1.85 mm

Diameter of discharge hole outlet: 8.0 μm

Drying temperature (nitrogen): 50° C.

Relative humidity of ethyl acetate (in nitrogen gas flow): 30%

Drive frequency: 340 kHz

Applied voltage to piezoelectric body: 10.0 V

The mother toner particles are mixed with external additives in the same manner as Example 1. Thus, a toner 8 is prepared. The toner 8 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1.

The measurement results of toner properties are shown in Table 2.

Example 9

Preparation of Toner 9

The procedure in Example 1 is repeated except that the polyester resin A is replaced with a polyester resin B, the wax 1 is replaced with a wax 9, the drying temperature is changed to 65° C., and the relative humidity of ethyl acetate is changed to 5%. Thus, a toner 9 is prepared.

The wax 9 is a synthetic amide wax having a melting point of 70.8° C. and a recrystallization temperature of 66.1° C. (available from NOF CORPORATION).

Both the wax 9 and the polyester resin B are dissolved in the ethyl acetate without causing phase separation and a transparent liquid is obtained.

The toner composition liquid and the members of the toner manufacturing apparatus which contact the toner composition liquid are temperature-controlled to 55° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the same criteria used in Example 1. The results are shown in Table 3.

The toner 9 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1. The measurement results of toner properties are shown in Table 2.

Example 10

Preparation of Toner 10

The procedure in Example 1 is repeated except that the wax 1 is replaced with 5 parts of the wax 1 and 5 parts of the wax 2, the drying temperature is changed to 60° C., and the relative humidity of ethyl acetate is changed to 6%. Thus, a toner 10 is prepared.

All the wax 1, the wax 2, and the polyester resin A are dissolved in the ethyl acetate without causing phase separation and a transparent liquid is obtained.

The toner composition liquid and the members of the toner manufacturing apparatus which contact the toner composition liquid are temperature-controlled to 55° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the same criteria used in Example 1. The results are shown in Table 3.

The toner 10 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1. The measurement results of toner properties are shown in Table 2.

Example 11

Preparation of Toner 11

The procedure in Example 1 is repeated except that the wax 1 is replaced with 5 parts of the wax 1 and 5 parts of the wax 3, the drying temperature is changed to 60° C., and the relative humidity of ethyl acetate is changed to 5%. Thus, a toner 11 is prepared.

All the wax 1, the wax 3, and the polyester resin A are dissolved in the ethyl acetate without causing phase separation and a transparent liquid is obtained.

The toner composition liquid and the members of the toner manufacturing apparatus which contact the toner composition liquid are temperature-controlled to 55° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the same criteria used in Example 1. The results are shown in Table 3.

The toner 11 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1. The measurement results of toner properties are shown in Table 2.

Example 12

Preparation of Toner 12

The procedure in Example 1 is repeated except that the polyester resin A is replaced with a polyester resin B, the wax 1 is replaced with 5 parts of the wax 1 and 5 parts of the wax 3, the drying temperature is changed to 40° C., and the relative humidity of ethyl acetate is changed to 20%. Thus, a toner 12 is prepared.

All the wax 1, the wax 3, and the polyester resin B are dissolved in the ethyl acetate without causing phase separation and a transparent liquid is obtained.

The toner composition liquid and the members of the toner manufacturing apparatus which contact the toner composition liquid are temperature-controlled to 55° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the same criteria used in Example 1. The results are shown in Table 3.

The toner 12 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1. The measurement results of toner properties are shown in Table 2.

Example 13

Preparation of Toner 13

The procedure in Example 1 is repeated except that the wax 1 is replaced with 5 parts of the wax 1 and 5 parts of the wax 4, the drying temperature is changed to 60° C., and the relative humidity of ethyl acetate is changed to 5%. Thus, a toner 13 is prepared.

All the wax 1, the wax 4, and the polyester resin A are dissolved in the ethyl acetate without causing phase separation and a transparent liquid is obtained.

The toner composition liquid and the members of the toner manufacturing apparatus which contact the toner composition liquid are temperature-controlled to 55° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the same criteria used in Example 1. The results are shown in Table 3.

The toner 13 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1. The measurement results of toner properties are shown in Table 2.

Example 14

Preparation of Toner 14

The procedure in Example 1 is repeated except that the wax 1 is replaced with 5 parts of the wax 1 and 5 parts of the wax 5, the drying temperature is changed to 65° C., and the relative humidity of ethyl acetate is changed to 5%. Thus, a toner 14 is prepared.

All the wax 1, the wax 5, and the polyester resin A are dissolved in the ethyl acetate without causing phase separation and a transparent liquid is obtained.

The toner composition liquid and the members of the toner manufacturing apparatus which contact the toner composition liquid are temperature-controlled to 55° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the same criteria used in Example 1. The results are shown in Table 3.

The toner 14 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1. The measurement results of toner properties are shown in Table 2.

Example 15

Preparation of Toner 15

The procedure in Example 1 is repeated except that the wax 1 is replaced with 5 parts of the wax 4 and 5 parts of the wax 3, the drying temperature is changed to 65° C., and the relative humidity of ethyl acetate is changed to 6%. Thus, a toner 15 is prepared.

All the wax 4, the wax 3, and the polyester resin A are dissolved in the ethyl acetate without causing phase separation and a transparent liquid is obtained.

The toner composition liquid and the members of the toner manufacturing apparatus which contact the toner composition liquid are temperature-controlled to 55° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the same criteria used in Example 1. The results are shown in Table 3.

The toner 15 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1. The measurement results of toner properties are shown in Table 2.

Comparative Example 1

Preparation of Toner 16

The procedure in Example 1 is repeated except that the wax 1 is replaced with the wax 3, the polyester resin A is replaced with the polyester resin B, the toner composition liquid and the members of the toner manufacturing apparatus which contact the toner composition liquid are temperature-controlled to 40° C., and the drying temperature is changed to 55° C. Thus, a toner 16 is prepared.

Both the wax 3 and the polyester resin B are dissolved in the ethyl acetate without causing phase separation and a transparent liquid is obtained. The toner composition liquid and the members of the toner manufacturing apparatus which contact the toner composition liquid are temperature-controlled to 40° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the same criteria used in Example 1. The evaluation results for discharge stability are shown in Table 3.

The toner 16 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1.

The measurement results of toner properties are shown in Table 2.

Comparative Example 2

Preparation of Toner 17

The procedure in Example 1 is repeated except that the wax 1 is replaced with the wax 4, the polyester resin A is replaced with the polyester resin B, the toner composition liquid and the members of the toner manufacturing apparatus which contact the toner composition liquid are temperature-controlled to 40° C., and the drying temperature is changed to 50° C. Thus, a toner 17 is prepared.

Both the wax 5 and the polyester resin B are dissolved in the ethyl acetate without causing phase separation and a transparent liquid is obtained. The toner composition liquid and the members of the toner manufacturing apparatus which contact the toner composition liquid are temperature-controlled to 40° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the same criteria used in Example 1. The evaluation results for discharge stability are shown in Table 3.

The toner 17 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1.

The measurement results of toner properties are shown in Table 2.

Comparative Example 3

Preparation of Toner 18

The procedure in Example 6 is repeated except that the relative humidity is changed to 11% to 45%. However, the resulting toner particles cause blocking in the toner collector and are not evaluable.

Comparative Example 4

Preparation of Toner 19

The procedure for preparing the toner composition liquid in Example 4 is repeated except that the wax 4 is not dissolved but dispersed in the ethyl acetate.

Preparation of Wax Dispersion Liquid

In a vessel equipped with stirrer blades and a thermometer, 10 parts of the wax 4 and 90 parts of ethyl acetate are heated to 60° C. and stirred for 20 minutes to dissolve the wax 4 in the ethyl acetate, followed by rapid cooling to precipitate fine particles of the wax 4. The resulting dispersion liquid is subjected to a dispersion treatment using a STAR MILL LMZ06 (from Ashizawa Finetech Ltd.) filled with zirconia beads having a diameter of 0.3 μm at a rotation speed of 1,800 rpm to more finely dispersed the wax. Thus, a wax 4 dispersion liquid, in which the average particle diameter is 0.3 μm and the maximum particle diameter is 0.8 μm, is prepared. The particle size of the wax is measured by an instrument NPA-150 from Microtrac, Inc.

Preparation of Toner Composition Liquid

After dissolving 273.3 parts of the polyester resin B, serving as the binder resin, in 626.7 parts of ethyl acetate, 100 parts of the wax 4 dispersion liquid and 100 parts of the carbon black dispersion liquid are mixed therein at 30° C. using a mixer having stirrer blades. Thus, a toner composition liquid is prepared.

Preparation of Toner

A toner is prepared from the above-obtained toner composition liquid using the toner manufacturing apparatus illustrated in FIG. 8 having the liquid droplet discharge device illustrated in FIG. 3 as follows. First, liquid droplets of the toner composition liquid are discharged. The liquid droplets are dried and solidified by the liquid droplet solidification device using dry nitrogen. The solidified particles are collected by a cyclone collector and fan-dried at 35° C., 90% RH for 48 hours, at 40°, 50% RH for 24 hours, and 50°, 50% RH for 24 hours. Thus, mother toner particles are obtained. The toner composition liquid and the members of the toner manufacturing apparatus which contact the toner composition liquid are temperature-controlled to 30° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the same criteria used in Example 1. The evaluation results for discharge stability are shown in Table 3.

Toner Preparation Conditions

Longitudinal length (L) of liquid column resonance liquid chamber: 1.85 mm

Diameter of discharge hole outlet: 8.0 μm

Drying temperature (nitrogen): 40° C.

Drive frequency: 340 kHz

Applied voltage to piezoelectric body: 10.0 V

The mother toner particles are mixed with external additives in the same manner as Example 1. Thus, a toner 19 is prepared. The toner 19 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1.

The measurement results of toner properties are shown in Table 2.

The content of the wax in the toner 19 is determined by converting the endothermic quantity of the wax measured by a differential scanning calorimetry (DSC) into weight. The amount of the wax existing in a region ranging from the surface to 0.3 μm in depth of the toner 1 is determined by an attenuated total reflection infrared spectroscopy (FTIR-ATR).

The particle size of the toner is also measured. The results are shown in Table 1.

Comparative Example 5

Preparation of Toner 20

The procedure for preparing the toner composition liquid in Example 8 is repeated except that the wax 6 is not dissolved but dispersed in the ethyl acetate.

Preparation of Wax Dispersion Liquid

In a vessel equipped with stirrer blades and a thermometer, 10 parts of the wax 6 and 90 parts of ethyl acetate are heated to 70° C. and stirred for 20 minutes to dissolve the wax 6 in the ethyl acetate, followed by rapid cooling to precipitate fine particles of the wax 6. The resulting dispersion liquid is subjected to a dispersion treatment using a STAR MILL LMZ06 (from Ashizawa Finetech Ltd.) filled with zirconia beads having a diameter of 0.3 μm at a rotation speed of 1,800 rpm to more finely dispersed the wax. Thus, a wax 6 dispersion liquid in which wax particles having an average particle diameter of 0.4 μm and a maximum particle diameter of 0.8 μm are dispersed is prepared. The particle size of the wax is measured by an instrument NPA-150 from Microtrac, Inc.

Preparation of Toner Composition Liquid

After dissolving 273.3 parts of the polyester resin B, serving as the binder resin, in 626.7 parts of ethyl acetate, 100 parts of the wax 6 dispersion liquid and 100 parts of the carbon black dispersion liquid are mixed therein at 30° C. using a mixer having stirrer blades. Thus, a toner composition liquid is prepared.

Preparation of Toner

A toner is prepared from the above-obtained toner composition liquid using the toner manufacturing apparatus illustrated in FIG. 8 having the liquid droplet discharge device illustrated in FIG. 3 as follows. First, liquid droplets of the toner composition liquid are discharged. The liquid droplets are dried and solidified by the liquid droplet solidification device using dry nitrogen. The solidified particles are collected by a cyclone collector and fan-dried at 35° C., 90% RH for 48 hours, at 40°, 50% RH for 24 hours, and 50°, 50% RH for 24 hours. Thus, mother toner particles are obtained.

The toner composition liquid and the members of the toner manufacturing apparatus which contact the toner composition liquid are temperature-controlled to 30° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the same criteria used in Example 1. The results are shown in Table 3.

Toner Preparation Conditions

Longitudinal length (L) of liquid column resonance liquid chamber: 1.85 mm

Diameter of discharge hole outlet: 8.0 μm

Drying temperature (nitrogen): 40° C.

Drive frequency: 340 kHz

Applied voltage to piezoelectric body: 10.0 V

The mother toner particles are mixed with external additives in the same manner as Example 1. Thus, a toner 20 is prepared.

The toner 20 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1.

The measurement results of toner properties are shown in Table 2.

The content of the wax in the toner 20 is determined by converting the endothermic quantity of the wax measured by a differential scanning calorimetry (DSC) into weight. The amount of the wax existing in a region ranging from the surface to 0.3 μm in depth of the toner 1 is determined by an attenuated total reflection infrared spectroscopy (FTIR-ATR).

The particle size of the toner is also measured. The results are shown in Table 1.

Comparative Example 6

Preparation of Toner 21

The procedure in Example 1 is repeated except that the polyester resin A is replaced with a polyester resin B, the wax 1 is replaced with a wax 9, the drying temperature is changed to 40° C., and the relative humidity of ethyl acetate is changed to 6%. Thus, a toner 21 is prepared.

Both the wax 9 and the polyester resin B are dissolved in the ethyl acetate without causing phase separation and a transparent liquid is obtained.

The toner composition liquid and the members of the toner manufacturing apparatus which contact the toner composition liquid are temperature-controlled to 45° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the same criteria used in Example 1. The results are shown in Table 3.

The toner 21 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1. The measurement results of toner properties are shown in Table 2.

Comparative Example 7

Preparation of Toner 22

The procedure in Example 1 is repeated except that the polyester resin A is replaced with a polyester resin B, the wax 1 is replaced with 5 parts of the wax 1 and 5 parts of the wax 3, the drying temperature is changed to 40° C., and the relative humidity of ethyl acetate is changed to 6%. Thus, a toner 22 is prepared.

All the wax 1, the wax 3, and the polyester resin B are dissolved in the ethyl acetate without causing phase separation and a transparent liquid is obtained.

The toner composition liquid and the members of the toner manufacturing apparatus which contact the toner composition liquid are temperature-controlled to 45° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the same criteria used in Example 1. The results are shown in Table 3.

The toner 22 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1. The measurement results of toner properties are shown in Table 2.

Comparative Example 8

Preparation of Toner 23

The procedure in Example 1 is repeated except that the polyester resin A is replaced with a polyester resin B, the wax 1 is replaced with 5 parts of the wax 4 and 5 parts of the wax 3, the drying temperature is changed to 40° C., and the relative humidity of ethyl acetate is changed to 5%. Thus, a toner 23 is prepared.

All the wax 4, the wax 3, and the polyester resin B are dissolved in the ethyl acetate without causing phase separation and a transparent liquid is obtained.

The toner composition liquid and the members of the toner manufacturing apparatus which contact the toner composition liquid are temperature-controlled to 45° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the same criteria used in Example 1. The results are shown in Table 3.

The toner 23 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1. The measurement results of toner properties are shown in Table 2.

Comparative Example 9

Preparation of Toner 24

The procedure for preparing the toner composition liquid in Example 12 is repeated except that the wax 1 and the wax 3 are not dissolved but dispersed in the ethyl acetate.

Preparation 1 of Wax Dispersion Liquid

In a vessel equipped with stirrer blades and a thermometer, 10 parts of the wax 1 and 90 parts of ethyl acetate are heated to 65° C. and stirred for 20 minutes to dissolve the wax 1 in the ethyl acetate, followed by rapid cooling to precipitate fine particles of the wax 1. The resulting dispersion liquid is subjected to a dispersion treatment using a STAR MILL LMZ06 (from Ashizawa Finetech Ltd.) filled with zirconia beads having a diameter of 0.3 μm at a rotation speed of 1,800 rpm to more finely dispersed the wax. Thus, a wax 1 dispersion liquid in which wax particles having an average particle diameter of 0.3 μm and a maximum particle diameter of 0.9 μm are dispersed is prepared. The particle size of the wax is measured by an instrument NPA-150 from Microtrac, Inc.

Preparation 2 of Wax Dispersion Liquid

In a vessel equipped with stirrer blades and a thermometer, 10 parts of the wax 3 and 90 parts of ethyl acetate are heated to 70° C. and stirred for 20 minutes to dissolve the wax 3 in the ethyl acetate, followed by rapid cooling to precipitate fine particles of the wax 3. The resulting dispersion liquid is subjected to a dispersion treatment using a STAR MILL LMZ06 (from Ashizawa Finetech Ltd.) filled with zirconia beads having a diameter of 0.3 μm at a rotation speed of 1,800 rpm to more finely dispersed the wax. Thus, a wax 3 dispersion liquid in which wax particles having an average particle diameter of 0.4 μm and a maximum particle diameter of 0.9 μm are dispersed is prepared. The particle size of the wax is measured by an instrument NPA-150 from Microtrac, Inc.

Preparation of Toner Composition Liquid

After dissolving 273.3 parts of the polyester resin B, serving as the binder resin, in 626.7 parts of ethyl acetate, 50 parts of the wax 1 dispersion liquid, 50 parts of the wax 3 dispersion liquid, and 100 parts of the carbon black dispersion liquid are mixed therein at 30° C. using a mixer having stirrer blades. Thus, a toner composition liquid is prepared.

Preparation of Toner

A toner is prepared from the above-obtained toner composition liquid using the toner manufacturing apparatus illustrated in FIG. 8 having the liquid droplet discharge device illustrated in FIG. 3 as follows. First, liquid droplets of the toner composition liquid are discharged. The liquid droplets are dried and solidified by the liquid droplet solidification device using dry nitrogen. The solidified particles are collected by a cyclone collector and fan-dried at 35° C., 90% RH for 48 hours, at 40°, 50% RH for 24 hours, and 50°, 50% RH for 24 hours. Thus, mother toner particles are obtained.

The toner composition liquid and the members of the toner manufacturing apparatus which contact the toner composition liquid are temperature-controlled to 30° C. The toner manufacturing apparatus is continuously operated for 12 hours. After the continuous operation, the discharge holes in the liquid droplet discharge head are visually observed to determine the rate of the clogged discharge holes. Discharge stability is evaluated based on the same criteria used in Example 1. The results are shown in Table 3.

Toner Preparation Conditions

Longitudinal length (L) of liquid column resonance liquid chamber: 1.85 mm

Diameter of discharge hole outlet: 8.0 μm

Drying temperature (nitrogen): 40° C.

Drive frequency: 340 kHz

Applied voltage to piezoelectric body: 10.0 V

The mother toner particles are mixed with external additives in the same manner as Example 1. Thus, a toner 24 is prepared.

The toner 24 is subjected to the measurement of S1/S2, the content of the wax in the toner, the amount of the wax existing in a region ranging from a surface to 0.3 μm in depth of the toner, and the particle size in the same manner as Example 1.

The types of waxes and binder resins and toner manufacturing conditions are summarized in Table 1.

The measurement results of toner properties are shown in Table 2.

The content of the wax in the toner 24 is determined by converting the endothermic quantity of the wax measured by a differential scanning calorimetry (DSC) into weight. The amount of the wax existing in a region ranging from the surface to 0.3 μm in depth of the toner 1 is determined by an attenuated total reflection infrared spectroscopy (FTIR-ATR).

The particle size of the toner is also measured. The results are shown in Table 1.

Preparation of Carrier

A mixture of 100 parts of a silicone resin (organo straight silicone), 100 parts of toluene, 5 parts of γ-(2-aminoethyl) aminopropyl trimethoxysilane, and 10 parts of a carbon black is subjected to a dispersion treatment for 20 minutes using a HOMOMIXER to prepare a coating layer forming liquid. The coating layer forming liquid is applied to the surfaces of 1,000 parts of spherical magnetite particles having a particle diameter of 50 μm using a fluidized-bed coating device. Thus, a magnetic carrier is prepared.

Preparation of Two-component Developer

Each of the above prepared toners 1 to 24 in an amount of 4 parts is mixed with the magnetic carrier in an amount of 96.0 parts using a ball mill. Thus, two-component developers 1 to 24 are prepared.

Evaluation Results for Two-Component Developer

Each of the two-component developers 1 to 24 is subjected to the evaluation of cold offset resistance, hot offset resistance, charge stability, background fouling, and image stability as follows. The evaluation results are shown in Table 3.

Evaluation Methods

Particle Diameter and Particle Size Distribution

The weight average particle diameter (Dv) and number average particle diameter (Dn) of toner can be measured by a particle size analyzer MULTISIZER III (from Beckman Coulter, Inc.) with setting the aperture diameter to 50 p.m. The volume and number of toner particles are measured first, and then the volume distribution and number distribution are calculated. The volume average particle diameter (Dv) and number average particle diameter (Dn) are determined from the volume distribution and number distribution, respectively. The ratio (Dv/Dn) of the volume average particle diameter (Dv) to the number average particle diameter (Dn) can be used as an indicator of particle size distribution. When the particle size distribution is monodisperse, the ratio (Dv/Dn) becomes 1. The greater the ratio (Dv/Dn), the wider the particle size distribution.

Cold Offset Resistance

Each of the developers is set in a commercially-available copier IMAGIO NEO C600 (from Ricoh Co., Ltd.). A rectangular image having a size of 3 cm×5 cm is formed on an A4-size paper sheet (T6000 700W machine direction, from Ricoh Co., Ltd.) at a position 5 cm away from the leading edge of the sheet with a toner deposition amount of 0.85 mg/cm$^2$. The image is fixed on the sheet while controlling the fixing member to have a temperature of 130° C. and a linear speed of 300 mm/sec. The toner deposition amount is calculated from the weight difference of the sheet before and after the image formation. The image is visually observed to determine whether offset has occurred or not at 130° C., and cold offset resistance is evaluated based on the following criteria.

AA: Cold offset has not occurred.

A: The number of portions where cold offset has slightly occurred is 3 or less.

B: The number of portions where cold offset has slightly occurred is greater than 3.

C: Cold offset has occurred.

Hot Offset Resistance

Each of the developers is set in a commercially-available copier IMAGIO NEO C600 (from Ricoh Co., Ltd.). A rectangular image having a size of 3 cm×5 cm is formed on a plurality of A4-size paper sheets (T6000 700W machine direction, from Ricoh Co., Ltd.) at a position 5 cm away from the leading edge of the sheet with a toner deposition amount of 0.85 mg/cm$^2$. Each image is fixed on each sheet while varying the fixing temperature from a low temperature to a high temperature. The offset temperature is defined as a temperature at which the image gloss has decreased or offset has occurred. Hot offset resistance is evaluated based on the following criteria.

A: The offset temperature is 200° C. or more.

C: The offset temperature is less than 200° C.

Charge Stability

Each of the developers is set in a tandem color image forming apparatus IMAGIO NEO C600 (from Ricoh Co., Ltd.). A running test in which an image chart having an image area ratio of 20% is continuously printed on 200,000 paper sheets is conducted while controlling the toner density such that the image density is kept at 1.4±0.2. Charge stability is evaluated in terms of the amount of change in charge quantity (μC/g) of the developer before and after the running test, i.e., the ratio of the amount of decrease in charge quantity after the running test to the initial charge quantity, based on the following criteria. The charge quantity is measured by a blow off method.

AA: less than 15%

A: not less than 15% and less than 30%

B: not less than 30% and less than 50%

C: not less than 50% The charge quantity is decreased as the toner is adhered to the carrier or the toner itself deteriorates.

The smaller the amount of change in charge quantity before and after the running test, the smaller the degree of toner filming on the carrier.

Background Fouling

Each of the developers is set in a tandem color image forming apparatus IMAGIO NEO C600 (from Ricoh Co., Ltd.). A miming test in which an image chart having an image area ratio of 5% is continuously printed on 200,000 paper sheets is conducted. After the running test, the image is visually observed to determine whether or not the image background portion has fouling. The degree of background fouling is evaluated based on the following criteria.

A: No fouling is observed in the image background portion.

B: A slight fouling is observed in the image background portion.

C: Fouling is observed in the image background portion.

Image Stability

Each of the developers is set in a commercially-available copier IMAGIO NEO 455 (from Ricoh Co., Ltd.). A running test in which an image chart having an image area ratio of 7% is continuously printed on 50,000 sheets of a paper TYPE 6000 (from Ricoh Co., Ltd.) is conducted. Image stability is evaluated in terms of image quality (i.e., image density and thin-line reproducibility) of the 50,000th image based on the following criteria.

A: The 50,000th image is equivalent to the initial image in terms of image quality.

B: The 50,000th image has been changed from the initial image with acceptable level in terms of image quality and/or thin-line reproducibility.

C: The 50,000th image has been significantly changed from the initial image in terms of image quality and/or thin-line reproducibility, which is beyond the acceptable level.

Winding Force (Resistive Force to Separation)

Figure 10:
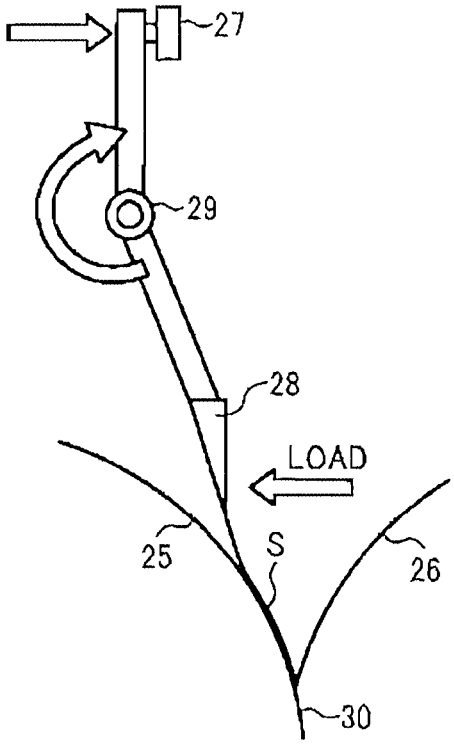
FIG. 10 is a schematic view of a device for measuring a force needed for separating a recording medium having an image thereon from a fixing member (i.e., resistive force to separation), used in Examples and Comparative Examples.

A force needed for separating a recording medium from a fixing member (i.e., resistive force to separation) is measured by a measuring device illustrated in FIG. 10 that measures a pressing force against a recording medium, to evaluate separability. Referring to FIG. 10, a recording medium S is pressed against a measuring claw 28 while being fed. The pressing force is read by a load cell 27 disposed on the other end of the measuring claw 28 through a supporting point 29.

The measuring claw 28 is disposed at immediately downstream from a nip portion 30 between a fixing roller 25 and a pressing roller 26 on a fixing-roller-25 side. The value read by the load cell 27 indicates a force needed for separating the recording medium S from the fixing roller 25 (i.e., resistive force to separation). A smaller resistive force indicates a better separability.

Whether the recording medium is separable from the fixing roller or not is determined based on the resistive force to separation measured in the above manner. Separability is evaluated in terms of the resistive force to separation measured at a fixing temperature of 160° C. based on the following criteria.

The toner deposition amount is 0.9 g/cm$^2$.

Evaluation Criteria (Resistive Force to Separation)

AA: from 0 to 50 gf

A: from 50 to 200 gf

B: from 200 to 400 gf

C: 400 gf or more

When the resistive force to separation is 50 gf, the recording medium is separable even when the margin is 0 mm. When the resistive force to separation is 200 gf or less, the recording medium is separable when the margin is 2 mm or more. When the resistive force to separation is 400 gf or less, the recording medium is separable when the margin is 4 mm or more. When the resistive force to separation is 400 gf or more, the recording medium is inseparable and likely to causes paper winding and paper clogging.

Evaluation Results for One-Component Developers

Each of the toners 1 to 24, as a one-component developer, is subjected to the evaluation of cold offset resistance, hot offset resistance, adherence resistance, background fouling, and image stability as follows. The evaluation results are shown in Table 3.

Evaluation Methods

Cold Offset Resistance

Each of the developer is set in a modified machine of IPSIO SP C220 (from Ricoh Co., Ltd.) which has been modified such that the temperature of the fixing roller is variable. A solid image having a toner deposition amount of 1.00±0.05 mg/cm$^2$ is formed on a sheet of a paper TYPE 6200 (from Ricoh Co., Ltd.). The solid image is fixed on the sheet while controlling the fixing roller to have a temperature of 140° C. The fixed image is visually observed to determine whether offset has occurred or not at 140° C., and cold offset resistance is evaluated based on the following criteria.

AA: Cold offset has not occurred.

A: The number of portions where cold offset has slightly occurred is 3 or less.

B: The number of portions where cold offset has slightly occurred is greater than 3.

C: Cold offset has occurred.

Hot Offset Resistance

Each of the developer is set in a modified machine of IPSIO SP C220 (from Ricoh Co., Ltd.) which has been modified such that the temperature of the fixing roller is variable. A solid image having a toner deposition amount of 1.00±0.05 mg/cm$^2$ is formed on a plurality of sheets of a paper TYPE 6200 (from Ricoh Co., Ltd.). Each image is fixed on each sheet while varying the fixing temperature from a low temperature to a high temperature. The offset temperature is defined as a temperature at which the image gloss has decreased or offset has occurred. Hot offset resistance is evaluated based on the following criteria.

A: The offset temperature is 200° C. or more.

C: The offset temperature is less than 200° C.

Adherence Resistance

Each of the developer is set in IPSIO SP C220 (from Ricoh Co., Ltd.). After printing white solid image on 2,000 sheets of paper, the degree of toner adherence to the regulating blade is evaluated based on the following criteria.

AA: No toner adherence has occurred. Very good.

A: Toner adherence has slightly occurred without affecting image quality.

B: Toner adherence has occurred with affecting image quality.

C: Toner adherence has significantly occurred with greatly affecting image quality.

Background Fouling

Each of the developer (toner) is set in the Bk cartridge of IPSIO SP C220 (from Ricoh Co., Ltd.). After idly printing out a white paper sheet, the white paper sheet and the photoconductor are observed to evaluate the degree of background fouling based on the following criteria.

AA: Toner adherence is not observable on either the white paper sheet or the photoconductor.

A: Toner adherence is not observable on the white paper sheet but is slightly observable on the photoconductor as it is tilted.

B: Toner adherence is slightly observable on the white paper sheet as it is tilted.

C: Toner adherence is clearly observable on the white paper sheet.

Image Stability

Each of the developer is set in IPSIO SP C220 (from Ricoh Co., Ltd.). A black solid image is printed on a sheet of a paper TYPE 6000 (from Ricoh Co., Ltd.) before and after a running test in which an image chart having an image area ratio of 1% is continuously printed on 2,000 paper sheets. The image density of each black solid image is measured with a spectrophotometer (from X-Rite). Image stability is evaluated in terms of the difference in image density of the black solid image before and after the running test based on the following criteria.

AA: The difference in image density is less than 0.1%.

A: The difference in image density is not less than 0.1% and less than 0.2%.

B: The difference in image density is not less than 0.2% and less than 0.3%.

C: The difference in image density is not less than 0.3%.

Comprehensive Evaluation Score

Comprehensive evaluation score is calculated by adding all the scores given in each evaluation. AA gives 3 points, A gives 2 points, B gives 1 point, and C and "not evaluable" gives 0 point. The greater the comprehensive evaluation score, the better.

TABLE 1

| | | Wax | | | | Resin | | | Drying Conditions | |
|---|---|---|---|---|---|---|---|---|---|---|
| | Toner No. | No | Melting Point (° C.) | Crystallization Temperarue (Tc) (° C.) | Solubility Parameter | No. | Solubility Parameter | (Tc-5)° C. | Drying Temperature (° C.) | Solvent Relative Humidity (%) |
| Example 1 | 1 | Wax 1 | 62.6 | 52.7 | 9.2 | Polyester A | 11.3 | 47.7 | 60 | 5 |
| Example 2 | 2 | Wax 2 | 70.3 | 64.1 | 8.9 | Polyester A | 11.3 | 59.1 | 65 | 6 |
| Example 3 | 3 | Wax 3 | 75.2 | 64.3 | 8.6 | Polyester A | 11.3 | 59.3 | 60 | 5 |
| Example 4 | 4 | Wax 4 | 67.4 | 60.5 | 8.5 | Polyester A | 11.3 | 55.5 | 60 | 6 |
| Example 5 | 5 | Wax 5 | 71.7 | 64.5 | 9.0 | Polyester A | 11.3 | 59.5 | 60 | 5 |
| Example 6 | 6 | Wax 5 | 71.7 | 64.5 | 9.0 | Polyester B | 10.5 | 59.5 | 40 | 11 |
| Example 7 | 7 | Wax 5 | 71.7 | 64.5 | 9.0 | Polyester B | 10.5 | 59.5 | 40 | 40 |
| | | | | | | Styrene-Acrylic A | 9.1 | | | |
| Example 8 | 8 | Wax 6 | 74.1 | 70.1 | 8.1 | Styrene-Acrylic A | 9.1 | 65.1 | 50 | 30 |
| Example 9 | 9 | Wax 7 | 70.8 | 66.1 | 9.9 | Polyester B | 10.5 | 61.1 | 65 | 5 |
| Example 10 | 10 | Wax 1 | 62.6 | 52.7 | 9.2 | Polyester A | 11.3 | 59.1 | 60 | 6 |
| | | Wax 2 | 70.3 | 64.1 | 8.9 | | | | | |
| Example 11 | 11 | Wax 1 | 62.6 | 52.7 | 9.2 | Polyester A | 11.3 | 59.3 | 60 | 5 |
| | | Wax 3 | 75.2 | 64.3 | 8.6 | | | | | |
| Example 12 | 12 | Wax 1 | 62.6 | 52.7 | 9.2 | Polyester B | 10.5 | 59.3 | 40 | 20 |
| | | Wax 3 | 75.2 | 64.3 | 8.6 | | | | | |
| Example 13 | 13 | Wax 1 | 62.6 | 52.7 | 9.2 | Polyester A | 11.3 | 55.5 | 60 | 5 |
| | | Wax 4 | 67.4 | 60.5 | 8.5 | | | | | |
| Example 14 | 14 | Wax 1 | 62.6 | 52.7 | 9.2 | Polyester A | 11.3 | 59.5 | 65 | 5 |
| | | Wax 5 | 71.7 | 64.5 | 9.0 | | | | | |
| Example 15 | 15 | Wax 4 | 67.4 | 60.5 | 8.5 | Polyester A | 11.3 | 59.3 | 65 | 6 |
| | | Wax 3 | 75.2 | 64.3 | 8.6 | | | | | |
| Comparative Example 1 | 16 | Wax 3 | 75.2 | 64.3 | 8.6 | Polyester B | 10.5 | 59.3 | 55 | 5 |
| Comparative Example 2 | 17 | Wax 4 | 67.4 | 60.5 | 8.5 | Polyester B | 10.5 | 55.5 | 50 | 5 |
| Comparative Example 3 | 18 | Wax 5 | 71.7 | 64.5 | 9.0 | Polyester B | 10.5 | 59.5 | 40 | 45 |

TABLE 1-continued

| | | Wax | | | | Resin | | | Drying Conditions | |
|---|---|---|---|---|---|---|---|---|---|---|
| | Toner No. | No | Melting Point (° C.) | Crystallization Temperarue (Tc) (° C.) | Solubility Parameter | No. | Solubility Parameter | (Tc-5)° C. | Drying Temperature (° C.) | Solvent Relative Humidity (%) |
| Comparative Example 4 | 19 | Wax 4 | 67.4 | 60.5 | 8.5 | Polyester B | 10.5 | 55.5 | 40 | 5 |
| Comparative Example 5 | 20 | Wax 6 | 74.1 | 70.1 | 8.1 | Polyester B | 10.5 | 65.1 | 40 | 5 |
| Comparative Example 6 | 21 | Wax 7 | 70.8 | 66.1 | 9.9 | Polyester B | 10.5 | 61.1 | 40 | 6 |
| Comparative Example 7 | 22 | Wax 1<br>Wax 3 | 62.6<br>75.2 | 52.7<br>64.3 | 9.2<br>8.6 | Polyester B | 10.5 | 59.3 | 40 | 6 |
| Comparative Example 8 | 23 | Wax 4<br>Wax 3 | 67.4<br>75.2 | 60.5<br>64.3 | 8.5<br>8.6 | Polyester B | 10.5 | 59.3 | 40 | 5 |
| Comparative Example 9 | 24 | Wax 1<br>Wax 3 | 62.6<br>75.2 | 52.7<br>64.3 | 9.2<br>8.6 | Polyester B | 10.5 | 59.3 | 40 | 6 |

20

TABLE 2

| | | Wax | | | | | | | | | Wax Amount from Surface to 0.3-μm depth | | |
|---|---|---|---|---|---|---|---|---|---|---|---|---|---|
| | Toner No. | No. | Melting Point (° C.) | Crystallization Temperature (Tc) (° C.) | Resin | Dv (μm) | Dv/Dn | Model Diameter (μm) | Second Peak (μm) | Wax Content (%) | (%) | S1/S2 | ΔSP |
| Example 1 | 1 | Wax 1 | 62.6 | 52.7 | Polyester A | 5.4 | 1.11 | 4.8 | 6.1 | 3.2 | 1.1 | 0.56 | 2.1 |
| Example 2 | 2 | Wax 2 | 70.3 | 64.1 | Polyester A | 5.6 | 1.12 | 4.8 | 6.2 | 3.1 | 2.5 | 0.47 | 2.4 |
| Example 3 | 3 | Wax 3 | 75.2 | 64.3 | Polyester A | 5.3 | 1.11 | 4.7 | 5.7 | 3.1 | 3.4 | 0.96 | 2.7 |
| Example 4 | 4 | Wax 4 | 67.4 | 60.5 | Polyester A | 5.2 | 1.10 | 4.9 | 6.1 | 3.2 | 0.2 | 0.81 | 2.8 |
| Example 5 | 5 | Wax 5 | 71.7 | 64.5 | Polyester A | 5.4 | 1.09 | 4.8 | 6.2 | 3.2 | 4.0 | 0.67 | 2.3 |
| Example 6 | 6 | Wax 5 | 71.7 | 64.5 | Polyester B | 5.6 | 1.14 | 4.9 | 6.4 | 3.0 | 2.4 | 0.55 | 1.5 |
| Example 7 | 7 | Wax 5 | 71.7 | 64.5 | Polyester B Styrene-Acrylic A | 5.8 | 1.17 | 4.9 | 6.2 | 3.1 | 3.1 | 0.7 | 1.2 |
| Example 8 | 8 | Wax 6 | 74.1 | 70.1 | Styrene-Acrylic A | 5.2 | 1.13 | 4.6 | 5.7 | 3.2 | 3.0 | 0.6 | 1.0 |
| Example 9 | 9 | Wax 7 | 70.8 | 66.1 | Polyester B | 5.2 | 1.11 | 4.9 | 6.2 | 3.2 | 2.5 | 0.66 | 0.6 |
| Example 10 | 10 | Wax 1<br>Wax 2 | 62.6<br>70.3 | 52.7<br>64.1 | Polyester A | 5.3 | 1.11 | 4.8 | 6.2 | 3.3 | 1.1 | 0.46 | 2.4 |
| Example 11 | 11 | Wax 1<br>Wax 3 | 62.6<br>75.2 | 52.7<br>64.3 | Polyester A | 5.4 | 1.10 | 4.8 | 6.1 | 3.2 | 1.2 | 0.95 | 2.7 |
| Example 12 | 12 | Wax 1<br>Wax 3 | 62.6<br>75.2 | 52.7<br>64.3 | Polyester B | 5.2 | 1.11 | 4.9 | 6.2 | 3.1 | 0.8 | 0.98 | 1.9 |
| Example 13 | 13 | Wax 1<br>Wax 4 | 62.6<br>67.4 | 52.7<br>60.5 | Polyester A | 5.3 | 1.10 | 4.8 | 6.1 | 3.1 | 0.2 | 0.76 | 2.8 |
| Example 14 | 14 | Wax 1<br>Wax 5 | 62.6<br>71.7 | 52.7<br>64.5 | Polyester A | 5.2 | 1.11 | 4.9 | 6.0 | 3.2 | 4.0 | 0.5 | 2.3 |
| Example 15 | 15 | Wax 4<br>Wax 3 | 67.4<br>75.2 | 60.5<br>64.3 | Polyester A | 5.3 | 1.10 | 4.9 | 6.2 | 3.0 | 0.9 | 0.81 | 2.7 |
| Comparative Example 1 | 16 | Wax 3 | 75.2 | 64.3 | Polyester B | 5.3 | 1.09 | 4.9 | 6.0 | 3.0 | 4.5 | 0.15 | 1.9 |
| Comparative Example 2 | 17 | Wax 4 | 67.4 | 60.5 | Polyester B | 5.4 | 1.10 | 4.7 | 6.1 | 3.0 | 4.1 | 0.39 | 2.0 |
| Comparative Example 3 | 18 | Wax 5 | 71.7 | 64.5 | Polyester B | — | — | — | — | — | — | — | — |
| Comparative Example 4 | 19 | Wax 4 | 67.4 | 60.5 | Polyester B | 5.4 | 1.25 | 4.8 | 6.7 | 3.1 | 5.1 | 0.06 | 2.0 |
| Comparative Example 5 | 20 | Wax 6 | 74.1 | 70.1 | Polyester B | 5.4 | 1.23 | 4.8 | 6.7 | 3.0 | 4.1 | 0.09 | 2.4 |
| Comparative Example 6 | 21 | Wax 7 | 70.8 | 66.1 | Polyester B | 5.3 | 1.12 | 4.8 | 6.1 | 3.1 | 1.0 | 0.41 | 0.6 |
| Comparative Example 7 | 22 | Wax 1<br>Wax 3 | 62.6<br>75.2 | 52.7<br>64.3 | Polyester B | 5.4 | 1.12 | 4.8 | 6.1 | 3.0 | 0.7 | 0.35 | 1.9 |
| Comparative Example 8 | 23 | Wax 4<br>Wax 3 | 67.4<br>75.2 | 60.5<br>64.3 | Polyester B | 5.2 | 1.11 | 4.9 | 6.2 | 3.1 | 0.6 | 0.33 | 1.9 |
| Comparative Example 9 | 24 | Wax 1<br>Wax 3 | 62.6<br>75.2 | 52.7<br>64.3 | Polyester B | 5.3 | 1.12 | 4.8 | 6.1 | 2.9 | 0.8 | 0.13 | 1.9 |

TABLE 3

| | Two-Component Developers | | | | | | | One-Component Developers | | | | | Comprehensive |
|---|---|---|---|---|---|---|---|---|---|---|---|---|---|
| | Discharge Stability | Cold Offset Resistance | Hot Offset Resistance | Resistive Force to Separation | Charge Stability | Background Fouling | Image Stability | Cold Offset Resistance | Hot Offset Resistance | Adherence Resistance | Background Fouling | Image Stability | Evaluation Score |
| Example 1 | AA | AA | A | B | B | A | B | AA | A | B | A | A | 23 |
| Example 2 | B | AA | A | B | AA | A | A | A | A | AA | AA | A | 26 |
| Example 3 | B | AA | A | B | AA | A | A | AA | A | AA | AA | AA | 28 |
| Example 4 | B | A | A | B | AA | A | A | A | A | AA | A | A | 24 |
| Example 5 | A | AA | A | A | B | B | B | AA | A | B | B | B | 20 |
| Example 6 | B | A | A | A | AA | A | A | A | A | A | A | B | 23 |
| Example 7 | A | A | A | A | A | A | A | A | A | A | B | A | 23 |
| Example 8 | B | A | A | A | A | A | A | A | A | A | A | A | 23 |
| Example 9 | AA | A | A | AA | A | B | A | A | A | B | B | B | 22 |
| Example 10 | AA | A | A | AA | A | A | A | A | A | AA | A | A | 27 |
| Example 11 | A | AA | A | AA | AA | A | A | AA | A | AA | AA | AA | 31 |
| Example 12 | AA | A | A | AA | A | A | A | A | A | AA | A | A | 27 |
| Example 13 | AA | A | A | A | A | A | A | A | A | A | A | A | 25 |
| Example 14 | AA | AA | A | A | AA | A | A | A | A | AA | AA | A | 29 |
| Example 15 | AA | AA | A | AA | AA | A | A | AA | A | AA | AA | AA | 32 |
| Comparative Example 1 | B | B | A | B | B | C | A | B | A | C | C | B | 12 |
| Comparative Example 2 | B | B | A | B | A | A | C | B | A | B | B | C | 14 |
| Comparative Example 3 | C | — | — | — | — | — | — | — | — | — | — | — | 0 |
| Comparative Example 4 | B | C | A | C | A | A | C | C | A | B | B | C | 9 |
| Comparative Example 5 | C | B | C | C | A | B | C | C | C | B | B | B | 7 |
| Comparative Example 6 | B | B | A | B | A | B | B | B | A | B | C | B | 14 |
| Comparative Example 7 | AA | B | A | B | B | B | B | B | A | B | B | B | 16 |
| Comparative Example 8 | AA | B | A | B | A | A | B | B | A | B | B | B | 18 |
| Comparative Example 9 | C | B | C | B | B | C | B | C | C | C | B | B | 6 |

What is claimed is:

1. A toner, comprising:

a binder resin; and a release agent, wherein the toner satisfies the following inequation:

$$0.45 \leq (S1/S2) \leq 1.00$$

wherein S1 and S2 represent areas of quadrangles circumscribing the release agent and the toner, respectively, in a cross-sectional image of the toner obtained by a transmission electron microscope (TEM).

2. The toner according to claim 1, wherein the release agent comprises two or more types of release agents having different melting points.

3. The toner according to claim 2, wherein a difference in melting point among the two or more types of release agents is 7° C. or more.

4. The toner according to claim 1, wherein the release agent has a melting point of 65° C. or more.

5. The toner according to claim 1, wherein the release agent comprises at least one of an ester wax consisting essentially of a fatty acid ester, and an amide wax.

6. The toner according to claim 1, wherein the release agent is a wax, wherein a content of the wax in the toner is from 1% to 20% by weight, the content being determined by converting an endothermic quantity of the wax determined by a differential scanning calorimetry (DSC) into weight, and wherein an amount of the wax existing in a region ranging from a surface to 0.3 82 m in depth of the toner is not less than 0.1% by weight and less than 4% by weight, the amount being determined by an attenuated total reflection infrared spectroscopy (FTIR-ATR).

7. The toner according to claim 1, wherein the toner has a volume-based particle size distribution in which a second peak is observed at a particle diameter from 1.21 to 1.31 times a model diameter.

8. A method of manufacturing the toner according to claim 1, comprising:

forming liquid droplets by discharging a toner composition liquid in which the binder resin and the release agent are dissolved or dispersed in a solvent; and solidifying the liquid droplets into fine particles.

9. A developer, comprising:

the toner according to claim 1; and a carrier.

10. A process cartridge, comprising:

a latent image bearer;

a developing device to develop a latent image on the latent image bearer with the toner according to claim 1.

11. The toner according to claim 1, wherein the toner satisfies the following inequation: $0.70 \leq (S1/S2) \leq 1.00$.

12. The toner according to claim 11, wherein the release agent has a melting point of 69° C. - 120° C.

13. The toner according to claim 12, wherein the release agent is a wax, wherein a content of the wax in the toner is from 1% to 20% by weight, the content being determined by converting an endothermic quantity of the wax determined by a differential scanning calorimetry (DSC) into weight, and herein an amount of the wax existing in a region ranging from a surface to 0.3 μm in depth of the toner is not less than 0.1% by weight and less than 4% by weight, the amount being determined by an attenuated total reflection infrared spectroscopy (FTIR-ATR).

14. The toner according to claim 1, wherein the release agent has a melting point of 69° C. - 120° C.

* * * * *